US011837181B2

(12) United States Patent
Monomoshi

(10) Patent No.: US 11,837,181 B2
(45) Date of Patent: Dec. 5, 2023

(54) COLOR BALANCING IN DISPLAY OF MULTIPLE IMAGES

(71) Applicant: NICHIA CORPORATION, Anan (JP)

(72) Inventor: Masahiko Monomoshi, Itano-gun (JP)

(73) Assignee: Nichia Corporation, Anan (JP)

( * ) Notice: Subject to any disclaimer, the term of this patent is extended or adjusted under 35 U.S.C. 154(b) by 0 days.

(21) Appl. No.: 17/677,645

(22) Filed: Feb. 22, 2022

(65) Prior Publication Data

US 2022/0277699 A1 Sep. 1, 2022

(30) Foreign Application Priority Data

Feb. 26, 2021 (JP) ..... 2021-030118
Nov. 15, 2021 (JP) ..... 2021-185558

(51) Int. Cl.
*G09G 3/20* (2006.01)
*G09G 3/36* (2006.01)
*G09G 3/34* (2006.01)

(52) U.S. Cl.
CPC ..... *G09G 3/3426* (2013.01); *G09G 3/36* (2013.01); *G09G 2320/0626* (2013.01); *G09G 2340/16* (2013.01); *G09G 2360/06* (2013.01)

(58) Field of Classification Search
CPC ..... G09G 3/3426; G09G 3/36; G09G 2320/0626; G09G 2340/16; G09G 2360/16; G09G 3/2011; G09G 2320/0242; G09G 2320/0646; G09G 3/2096
See application file for complete search history.

(56) References Cited

U.S. PATENT DOCUMENTS

2005/0104841 A1* 5/2005 Sohn ..... G09G 3/3406 345/102
2005/0140631 A1* 6/2005 Oh ..... G09G 3/3611 345/89
2006/0028492 A1 2/2006 Yamaguchi et al.
2009/0184915 A1* 7/2009 Tsai ..... G09G 3/3406 345/102
2010/0265405 A1 10/2010 Toshima et al.
2011/0057961 A1 3/2011 Tsuru et al.
(Continued)

FOREIGN PATENT DOCUMENTS

JP 2005-351949 A 12/2005
JP 2006-047767 A 2/2006
(Continued)

*Primary Examiner* — Antonio Xavier
(74) *Attorney, Agent, or Firm* — Kim & Stewart LLP

(57) ABSTRACT

An image display method includes, with respect to each of a plurality of input images, generating luminance setting data that sets a luminance value for each of a plurality of light-emitting regions of a backlight configured in a matrix form based on the input image, generating gradation setting data that sets a gradation value for each of a plurality of pixels of a liquid crystal panel coupled to the backlight, based on the generated luminance setting data and the input image, and controlling the backlight based on the luminance setting data and the liquid crystal panel based on the gradation setting data to display an image. At least one of the luminance setting data and the gradation setting data for a first input image among the plurality of input images is generated based on the luminance setting data for a second input image immediately preceding the first input image.

14 Claims, 18 Drawing Sheets

(56) References Cited

U.S. PATENT DOCUMENTS

| | | | | |
|---|---|---|---|---|
| 2012/0281028 | A1* | 11/2012 | Orlick | G09G 3/3426 345/102 |
| 2014/0055505 | A1* | 2/2014 | Ikeda | G09G 3/22 345/690 |
| 2014/0340429 | A1* | 11/2014 | Inamura | G09G 3/3426 345/690 |
| 2016/0358557 | A1 | 12/2016 | Mori | |
| 2018/0025700 | A1* | 1/2018 | Suzuki | G09G 5/14 345/589 |
| 2018/0047345 | A1* | 2/2018 | Dunn | G02F 1/133606 |
| 2020/0202798 | A1* | 6/2020 | Kimbrell | G09G 3/3607 |
| 2021/0020102 | A1* | 1/2021 | Yamamoto | G09G 3/3233 |
| 2021/0043162 | A1* | 2/2021 | Henderson | G06T 5/50 |
| 2021/0074226 | A1 | 3/2021 | Ikeyama | |
| 2022/0277700 | A1* | 9/2022 | Monomoshi | G09G 3/3611 |
| 2022/0277701 | A1* | 9/2022 | Monomoshi | G09G 3/3611 |
| 2022/0277702 | A1* | 9/2022 | Monomoshi | G09G 3/3611 |

FOREIGN PATENT DOCUMENTS

| | | | |
|---|---|---|---|
| JP | 2008-268540 | A | 11/2008 |
| JP | 2010-250173 | A | 11/2010 |
| JP | 2011-059177 | A | 3/2011 |
| JP | 2012-226230 | A | 11/2012 |
| JP | 2017-003699 | A | 1/2017 |
| JP | 2019-009016 | A | 1/2019 |
| JP | 2019-174707 | A | 10/2019 |
| WO | 2019/124254 | A1 | 6/2019 |

* cited by examiner

COLOR BALANCING IN DISPLAY OF MULTIPLE IMAGES

CROSS-REFERENCE TO RELATED APPLICATIONS

This application is based upon and claims the benefit of priority from the prior Japanese Patent Application No. 2021-030118, filed on Feb. 26, 2021; and Japanese Patent Application No. 2021-185558, filed on Nov. 15, 2021; the entire contents of which are incorporated herein by reference.

FIELD

Embodiments relate to an image display method and a display that performs the same.

BACKGROUND

A conventionally-known image display device includes a backlight, a liquid crystal panel, and a controller. The backlight includes multiple light-emitting regions arranged in a matrix configuration and light sources in the light-emitting regions. The liquid crystal panel is located above the backlight and includes multiple pixels. In such an image display device, the controller can set luminances of the light-emitting regions differently for each of images to be displayed in the liquid crystal panel, and can set gradations of the pixels of the liquid crystal panel according to the set luminances of the light-emitting regions. The contrast of the image can be improved thereby. Such technology is called "local dimming".

The light-emitting regions of the backlight include light sources. Each light source includes a light-emitting element, and a phosphor having a light emission peak wavelength different from that of the light-emitting element. Each light source is configured to emit white light by combination of the light emitted by the light-emitting element and the light converted by the phosphor. However, when the controller changes the setting values of the luminances of the light-emitting regions, the color balance of the light emitted from the light sources may degrade because the light-emitting element responds faster than the phosphor.

SUMMARY

Embodiments are directed to an image display method and a display that can reduce degradation of the color balance of light emitted from a backlight.

An image display method includes, with respect to each of a plurality of input images, generating luminance setting data that sets a luminance value for each of a plurality of light-emitting regions of a backlight configured in a matrix form based on the input image, generating gradation setting data that sets a gradation value for each of a plurality of pixels of a liquid crystal panel coupled to the backlight, based on the generated luminance setting data and the input image, and controlling the backlight to operate based on the luminance setting data and the liquid crystal panel to operate based on the gradation setting data to display an image corresponding to the input image. At least one of the luminance setting data and the gradation setting data for a first input image among the plurality of input images is generated based on the luminance setting data for a second input image immediately preceding the first input image.

According to embodiments, an image display method and a display can be provided in which the degradation of the color balance of the light emitted from the backlight can be reduced.

DETAILED DESCRIPTION

Figure 1:
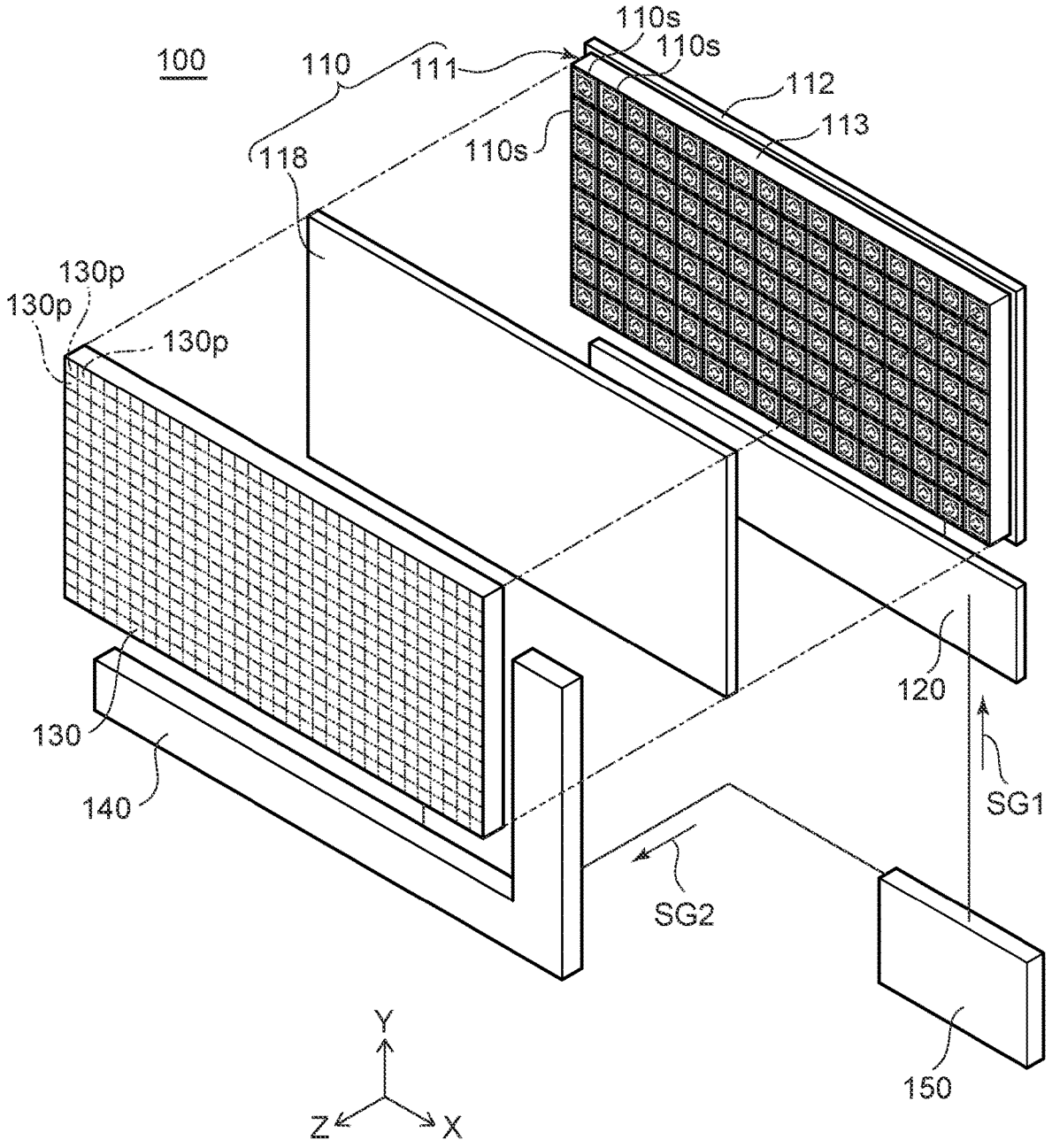
FIG. 1 illustrates an exploded perspective view of an image display device according to a first embodiment.

Exemplary embodiments will now be described with reference to the drawings. The drawings are schematic or conceptual; and the relationships between the thickness and width of portions, the proportional coefficients of sizes among portions, etc., are not necessarily the same as actual values thereof. Furthermore, the dimensions and proportional coefficients may be illustrated differently among the drawings, even for identical portions. In the specification and the drawings of the application, components similar to those described in regard to a drawing hereinabove are marked with like reference numerals, and a detailed description is omitted as appropriate.

For easier understanding of the following description, arrangements and configurations of portions of an image display device are described using an XYZ orthogonal coordinate system. X-axis, Y-axis, and Z-axis are orthogonal to each other. The direction in which the X-axis extends is referred to as an "X-direction"; the direction in which the Y-axis extends is referred to as a "Y-direction"; and the direction in which the Z-axis extends is referred to as a "Z-direction". For easier understanding of the description, the Z-direction is called up, and the opposite direction is called down, but these directions are independent of the direction of gravity. For easier understanding of the description of the drawings, the X-axis direction in the direction of the arrow is referred to as the "+X direction"; and the opposite direction is referred to as the "−X direction". Similarly, the Y-axis direction in the direction of the arrow is referred to as the "+Y direction"; and the opposite direction is referred to as the "−Y direction".

First Embodiment

First, a first embodiment will be described.

FIG. 1 illustrates an exploded perspective view of an image display device according to the first embodiment.

An image display device 100 according to the first embodiment is, for example, a liquid crystal module (LCM) used in a display of a device such as a television, a personal computer, a game machine, etc. The image display device 100 includes a backlight 110, a driver 120 for the backlight, a liquid crystal panel 130, a driver 140 for the liquid crystal panel, and a controller 150. Components of the image display device 100 will be described hereinafter. For easier understanding of the description, electrical connections between the components are shown by connecting the components to each other with solid lines in FIG. 1.

The backlight 110 is compatible with local dimming. The backlight 110 includes a planar light source 111, and an optical member 118 located on the planar light source 111.

Although not particularly limited, the optical member 118 is, for example, a sheet, a film, or a plate that has a light-modulating function such as a light-diffusing function, etc. According to the present embodiment, the number of the optical members 118 included in the backlight 110 is one. However, the number of optical members included in the backlight may be two or more.

Figure 2:
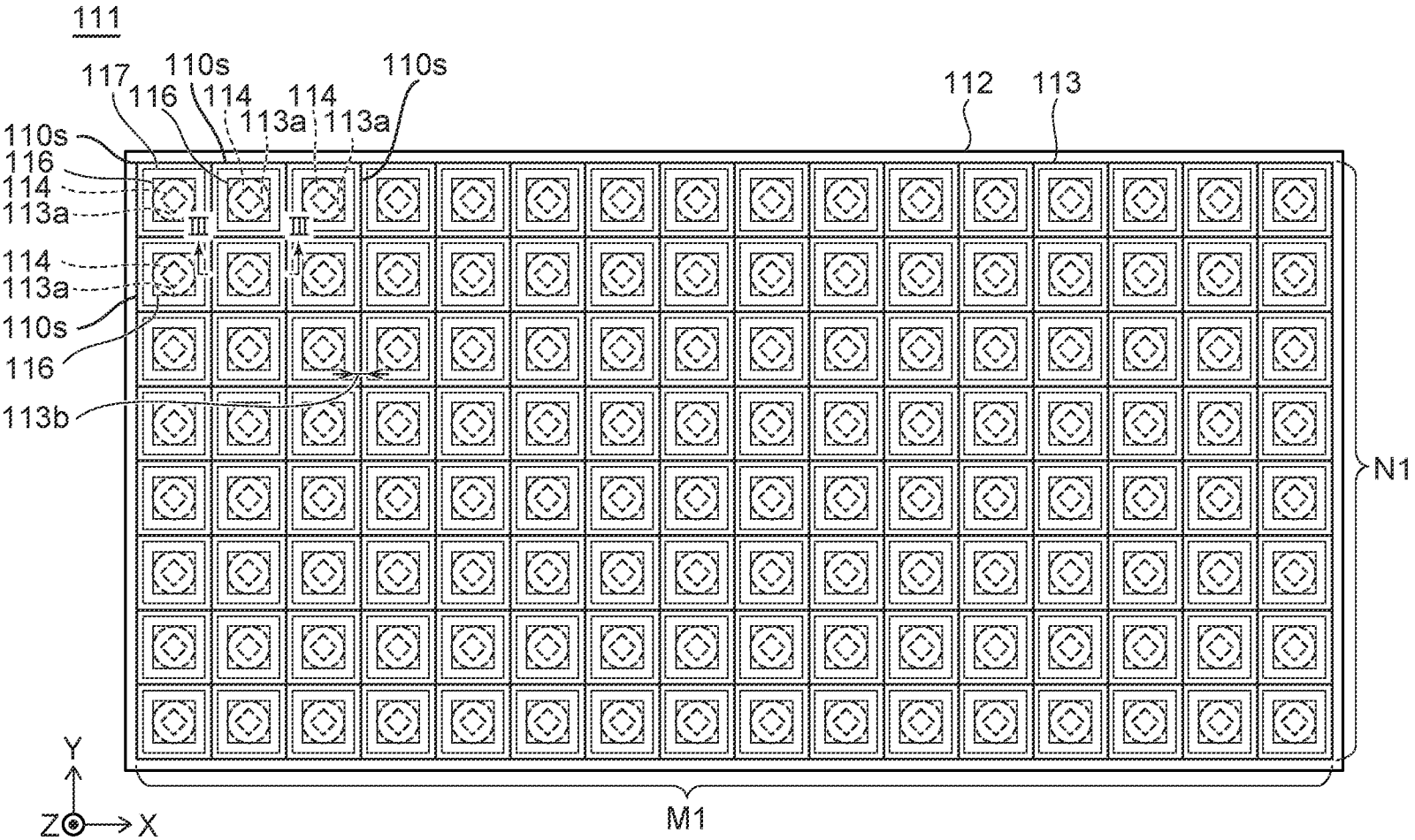
FIG. 2 illustrates a top view of a planar light source of a backlight included in the image display device according to the first embodiment.

FIG. 2 illustrates a top view of the planar light source of the backlight included in the image display device according to the first embodiment.

Figure 3:
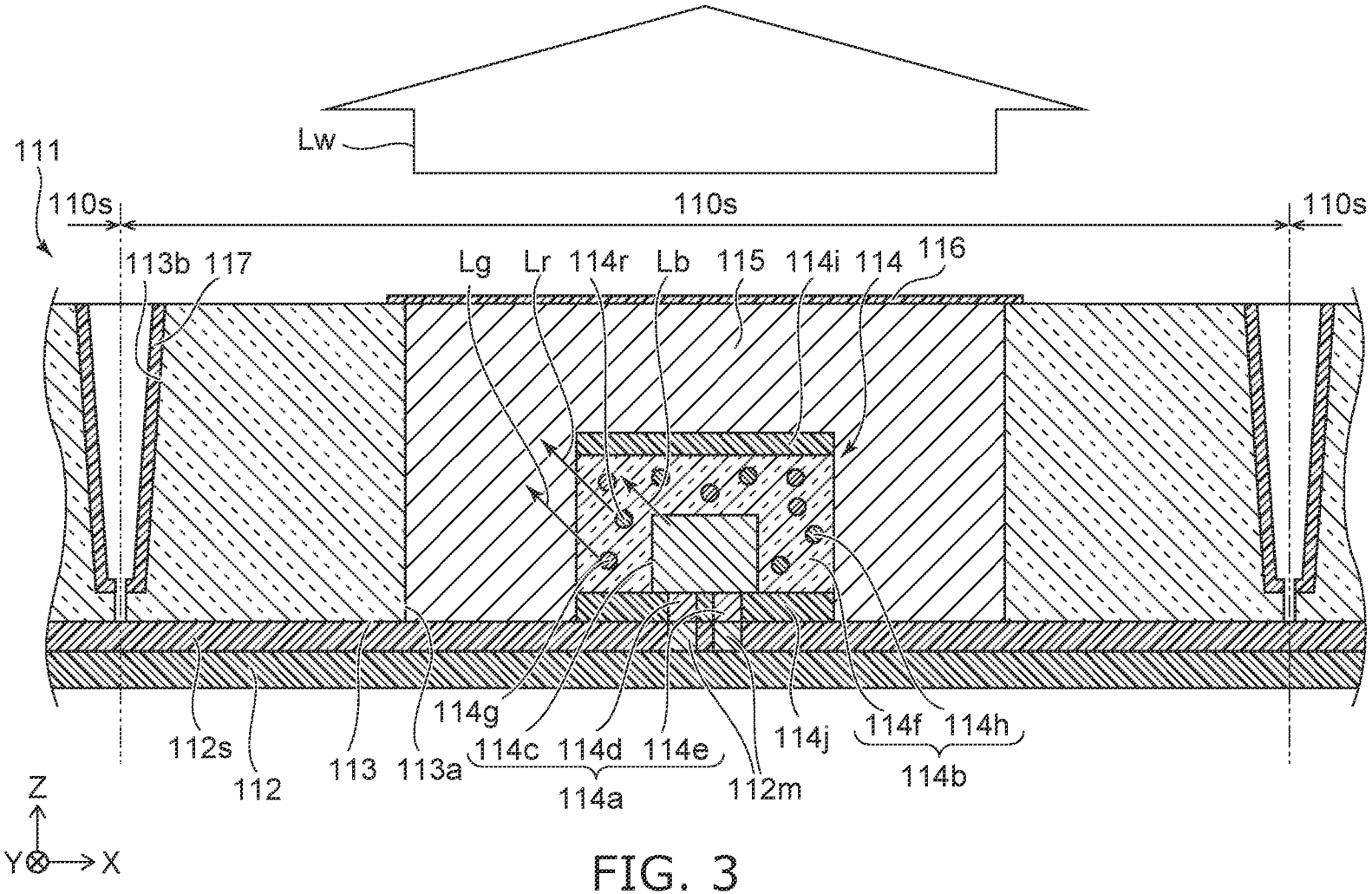
FIG. 3 illustrates a cross-sectional view of the planar light source along line III-III in FIG. 2.

FIG. 3 illustrates a cross-sectional view of the planar light source along line III-III in FIG. 2.

According to the first embodiment, as shown in FIGS. 2 and 3, the planar light source 111 includes a substrate 112, a light-reflective sheet 112*s*, a light guide member 113, multiple light sources 114, a light-transmitting member 115, a first light-modulating member 116, and a light-reflecting member 117.

The substrate 112 is a wiring substrate that includes an insulating member, and multiple wiring located in the insulating member. According to the present embodiment, the shape of the substrate 112 in top-view is substantially rectangular as shown in FIG. 2. However, the shape of the substrate is not limited to the aforementioned shape. The upper surface and the lower surface of the substrate 112 are flat surfaces and are substantially parallel to the X-direction and the Y-direction.

As shown in FIG. 3, the light-reflective sheet 112*s* is located on the substrate 112. According to the present embodiment, the light-reflective sheet 112*s* includes a first adhesive layer, a light-reflecting layer on the first adhesive layer, and a second adhesive layer on the light-reflecting layer. The light-reflective sheet 112*s* is adhered to the substrate 112 with the first adhesive layer.

The light guide member 113 is located on the light-reflective sheet 112*s*. At least a portion of a lower surface of the light guide member 113 is adhered to the light-reflective sheet 112*s* with the second adhesive layer. According to the present embodiment, the light guide member 113 is plate-shaped. The thickness of the light guide member 113 is preferably, for example, not less than 200 μm and not more than 800 μm. In the thickness direction, the light guide member 113 may include a single layer or may include a stacked body of multiple layers. According to the present embodiment, the shape of the light guide member 113 in top-view is substantially rectangular as shown in FIG. 2. However, the shape of the light guide member is not limited to the aforementioned shape.

For example, a thermoplastic resin such as acrylic, polycarbonate, cyclic polyolefin, polyethylene terephthalate, polyester, or the like, an epoxy, a thermosetting resin such as silicone or the like, and glass, etc., can be used as a material used for the light guide member 113.

Multiple light source placement portions 113*a* are located in the light guide member 113. The multiple light source placement portions 113*a* are arranged in a matrix configuration in top-view. According to the present embodiment, as shown in FIG. 3, each light source placement portion 113*a* is a through-hole that extends through the light guide member 113 in the Z-direction. Alternatively, the light source placement portion 113*a* may be a bottomed recess located at the lower surface of the light guide member 113.

The light sources 114 are located in the light source placement portions 113*a*, respectively. Accordingly, as shown in FIG. 2, multiple light sources 114 also are arranged in a matrix configuration. However, it is not always necessary for the light guide member 113 to be included in the planar light source 111. For example, the planar light source 111 may not include a light guide member, and the multiple light sources 114 may simply be arranged in a matrix configuration on the substrate 112. When no light guide member is included, the light source placement portion refers to a portion of the substrate 112 in which the light source 114 is located.

Each light source 114 may be a single light-emitting element or may include a light-emitting device in which, for example, a wavelength conversion member or the like is combined with a light-emitting element. According to the present embodiment, as shown in FIG. 3, each light source 114 includes a light-emitting element 114*a*, a wavelength conversion member 114*b*, a second light-modulating member 114*i*, and a third light-modulating member 114*j*.

The light-emitting element 114*a* is, for example, an LED (Light-Emitting Diode) and includes a semiconductor stacked body 114*c* and a pair of electrodes 114*d* and 114*e* that electrically connects the semiconductor stacked body 114*c* and the wiring of the substrate 112. Through-holes are provided in portions of the light-reflective sheet 112*s* positioned directly under the electrodes 114*d* and 114*e*. Conductive members 112*m* that electrically connect the substrate 112 and the electrodes 114*d* and 114*e* are located in the through-holes.

The wavelength conversion member 114*b* includes a light-transmitting member 114*f* that covers an upper surface and side surfaces of the semiconductor stacked body 114*c*, and a wavelength conversion substance 114*h* that is located in the light-transmitting member 114*f* and converts the wavelength of the light emitted by the semiconductor stacked body 114*c* into a different wavelength. The wavelength conversion substance 114*h* is, for example, a phosphor.

According to the present embodiment, the light-emitting element 114*a* emits blue light. On the other hand, the wavelength conversion member 114*b* includes, for example, a phosphor that converts incident light into red light (hereinbelow, called a red phosphor) such as a CASN-based phosphor (e.g., $CaAlSiN_3$:Eu), a quantum dot phosphor (e.g., $AgInS_2$ or $AgInSe_2$), a KSF-based phosphor (e.g., $K_2SiF_6$:Mn), a KSAF-based phosphor (e.g., $K_2(Si, Al)F_6$:Mn, and more specifically $K_2Si_{0.99}Al_{0.01}F_{5.99}$:Mn), or the like, a phosphor that converts incident light into green light (hereinbelow, called a green phosphor) such as a phosphor that has a perovskite structure (e.g., CsPb (F, Cl, Br, I)$_3$), a quantum dot phosphor (e.g., CdSe or InP), a β-sialon-based phosphor (e.g., $(Si, Al)_3(O, N)_4$:Eu), a LAG-based phosphor (e.g., $Lu_3(Al, Ga)_5O_{12}$:Ce), etc. Thereby, the backlight 110 can emit white light, which is a combination of the blue light emitted by the light-emitting element 114*a* and the red light and the green light from the wavelength conversion member 114*b*. The wavelength conversion member 114*b* may be a light-transmitting member that does not include any phosphor; in such a case, for example, a similar white light can be obtained by providing a phosphor sheet that includes a red phosphor and a green phosphor on the planar light source 111, or by providing a phosphor sheet including a red phosphor and a phosphor sheet including a green phosphor on the light guide member 113.

It is favorable for the KSAF-based phosphor to include the composition of the following Formula (I).

$$M_2[Si_pAl_qMn_rF_s] \quad (I)$$

In Formula (I), M is an alkaline metal; it is favorable for M to include at least K. It is favorable for Mn to be a tetravalent Mn ion. It is favorable for p, q, r, and s to satisfy $0.9 \le p+q+r \le 1.1$, $0 < q \le 0.1$, $0 < r \le 0.2$, and $5.9 \le s \le 6.1$. It is more favorable for $0.95 \le p+q+r \le 1.05$ or $0.97 \le p+q+r \le 1.03$; and for $0 < q \le 0.03$, $0.002 \le q \le 0.02$, or $0.003 \le q \le 0.015$; and for $0.005 \le r \le 0.15$, $0.01 \le r \le 0.12$, or $0.015 \le r \le 0.1$; and for $5.92 \le s \le 6.05$ or $5.95 \le s \le 6.025$. The compositions of $K_2[Si_{0.946}Al_{0.005}Mn_{0.049}F_{5.995}]$, $K_2[Si_{0.942}Al_{0.008}Mn_{0.050}F_{5.992}]$, and $K_2[Si_{0.939}Al_{0.014}Mn_{0.047}F_{5.986}]$ are examples. According to such a KSAF-based phosphor, a red light that has high luminance and a narrow width at half maximum of the light emission peak wavelength can be obtained.

The second light-modulating member 114*i* is located at an upper surface of the wavelength conversion member 114*b* and can modify the amount and/or the emission direction of the light emitted from the upper surface of the wavelength conversion member 114*b*. The third light-modulating member 114*j* is located at the lower surface of the light-emitting element 114*a* and the lower surface of the wavelength conversion member 114*b* so that the lower surfaces of the electrodes 114*d* and 114*e* are exposed. The third light-modulating member 114*j* can reflect the light oriented toward a lower surface of the wavelength conversion member 114*b* to the upper surface and side surfaces of the wavelength conversion member 114*b*. The second light-modulating member 114*i* and the third light-modulating member 114*j* each can include a light-transmitting resin, a light-diffusing agent included in the light-transmitting resin, etc. The light-transmitting resin is, for example, a silicone resin, an epoxy resin, or an acrylic resin. For example, particles of $TiO_2$, $SiO_2$, $Nb_2O_5$, $BaTiO_3$, $Ta_2O_5$, $Zr_2O_3$, $Y_2O_3$, $Al_2O_3$, ZnO, MgO, $BaSO_4$, glass, etc., are examples of the light-diffusing agent. The second light-modulating member 114*i* may also include a metal member such as, for example, Al, Ag, etc., so that the luminance directly above the light source 114 does not become too high.

The light-transmitting member 115 is located in the light source placement portion 113*a*. The light-transmitting member 115 covers the light source 114. The first light-modulating member 116 is located on the light-transmitting member 115. The first light-modulating member 116 can reflect a portion of the light incident from the light-transmitting member 115 and can transmit another portion of the light so that the luminance directly above the light source 114 does not become too high. The first light-modulating member 116 can include a member similar to the second light-modulating member 114*i* or the third light-modulating member 114*j*.

A partitioning trench 113*b* is provided in the light guide member 113 to surround the light source placement portions 113*a* in top-view. The partitioning trench 113*b* extends in a lattice shape in the X-direction and the Y-direction. The partitioning trench 113*b* extends through the light guide member 113 in the Z-direction. Alternatively, the partitioning trench 112*b* may be a recess provided in the upper surface or the lower surface of the light guide member 113. Also, the partitioning trench 112*b* may not be provided in the light guide member 113.

The light-reflecting member 117 is located in the partitioning trench 113*b*. For example, a light-transmitting resin that includes a light-diffusing agent can be used as the light-reflecting member 117. For example, particles of $TiO_2$, $SiO_2$, $Nb_2O_5$, $BaTiO_3$, $Ta_2O_5$, $Zr_2O_3$, ZnO, $Y_2O_3$, $Al_2O_3$, MgO, $BaSO_4$, glass, etc., are examples of the light-diffusing agent. For example, a silicone resin, an epoxy resin, an acrylic resin, etc., are examples of the light-transmitting resin. For example, a metal member such as Al, Ag, etc., may be used as the light-reflecting member 117. The light-reflecting member 117 covers a portion of side surfaces of the partitioning trench 113*b* in a layer shape. Alternatively, the light-reflecting member 117 may fill the entire interior of the partitioning trench 112*b*. Also, no light-reflecting member may be located in the partitioning trench 112*b*.

According to the present embodiment, light emission of the multiple light sources 114 is individually controllable by the driver 120 for the backlight. Here, "controllable light emission" means that switching between lit and unlit is possible, and the luminance in the lit state is adjustable. For example, the planar light source may have a structure in which the light emission is controllable for each light source, or may have a structure in which multiple light source groups are arranged in a matrix configuration, and the light emission is controllable for each light source group.

In the specification, subdivided regions of the planar light source each of which includes a light source or light source group that are individually controllable are referred to as "light-emitting regions". In other words, the light-emitting region means the minimum region of the backlight of which the luminance is controllable by local dimming. Accordingly, according to the present embodiment, similarly to the partitioning trench 113*b*, the regions of the planar light source 111 partitioned into a lattice shape correspond to light-emitting regions 110*s*.

Each light-emitting region 110*s* is rectangular. According to the present embodiment, one light source 114 is located in one light-emitting region 110*s*. Then, the luminances of the multiple light-emitting regions 110*s* are individually controlled by the driver 120 for the backlight individually controlling the light emission of the multiple light sources 114. As described above, when the light emission is controlled for each of multiple light source groups, one light source group, i.e., multiple light sources, is located in one light-emitting region; and the multiple light sources are simultaneously lit or unlit.

The multiple light-emitting regions 110*s* are arranged in a matrix configuration in top-view. Hereinbelow, in the structure of a matrix configuration such as that of the multiple light-emitting regions 110*s*, the element group of the matrix of the light-emitting region 110*s*, etc., arranged in the X-direction is called a "row"; and the element group of the matrix of the light-emitting region 110*s*, etc., arranged in the Y-direction is called a "column". For example, as shown in FIG. 2, the row that is positioned furthest in the +Y direction (the row positioned uppermost when viewed according to a direction of reference numerals) is referred to as the "first row"; and the row that is positioned furthest in the −Y direction (the row positioned lowermost when viewed according to the direction of reference numerals) is referred to as the "final row". Similarly, as shown in FIG. 2, the column that is positioned furthest in the −X direction (the column positioned leftmost when viewed according to the direction of reference numerals) is referred to as the "first column"; and the column that is positioned furthest in the +X direction (the column positioned rightmost when viewed according to the direction of reference numerals) is referred to as the "final column". The multiple light-emitting regions 110*s* are arranged in N1 rows and M1 columns. Here, N1 and M1 each are any integer; an example is shown in FIG. 2 in which N1 is 8 and M1 is 16.

As shown in FIG. 1, the driver 120 for the backlight is connected to the substrate 112 and the controller 150. The driver 120 for the backlight includes a drive circuit that drives the multiple light sources 114. The driver 120 for the backlight adjusts the luminances of the light-emitting regions 110*s* according to backlight control data SG1 received from the controller 150.

Figure 4:
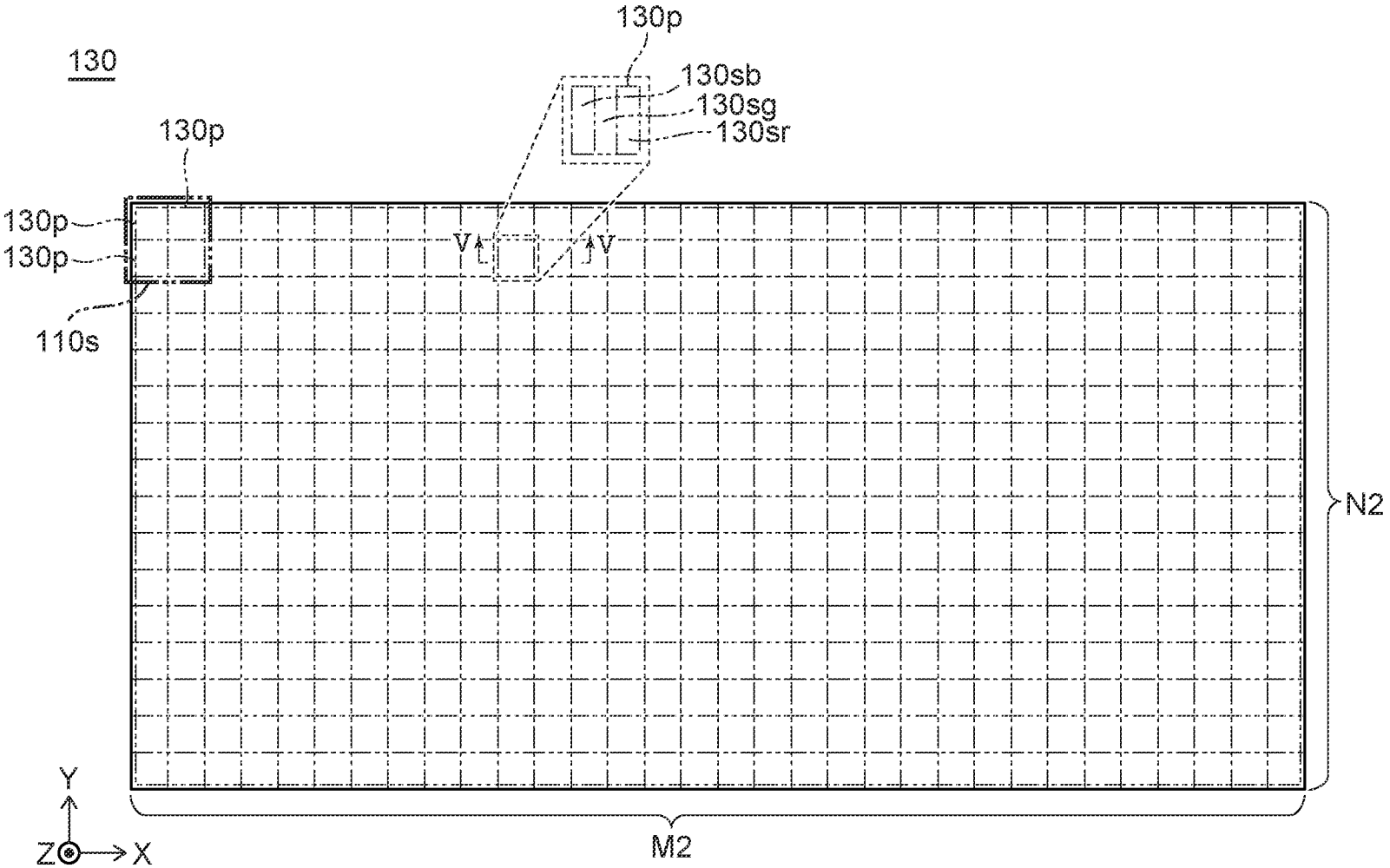
FIG. 4 illustrates a top view of a liquid crystal panel included in the image display device according to the first embodiment.

FIG. 4 illustrates a top view of the liquid crystal panel of the image display device according to the first embodiment.

Figure 5:
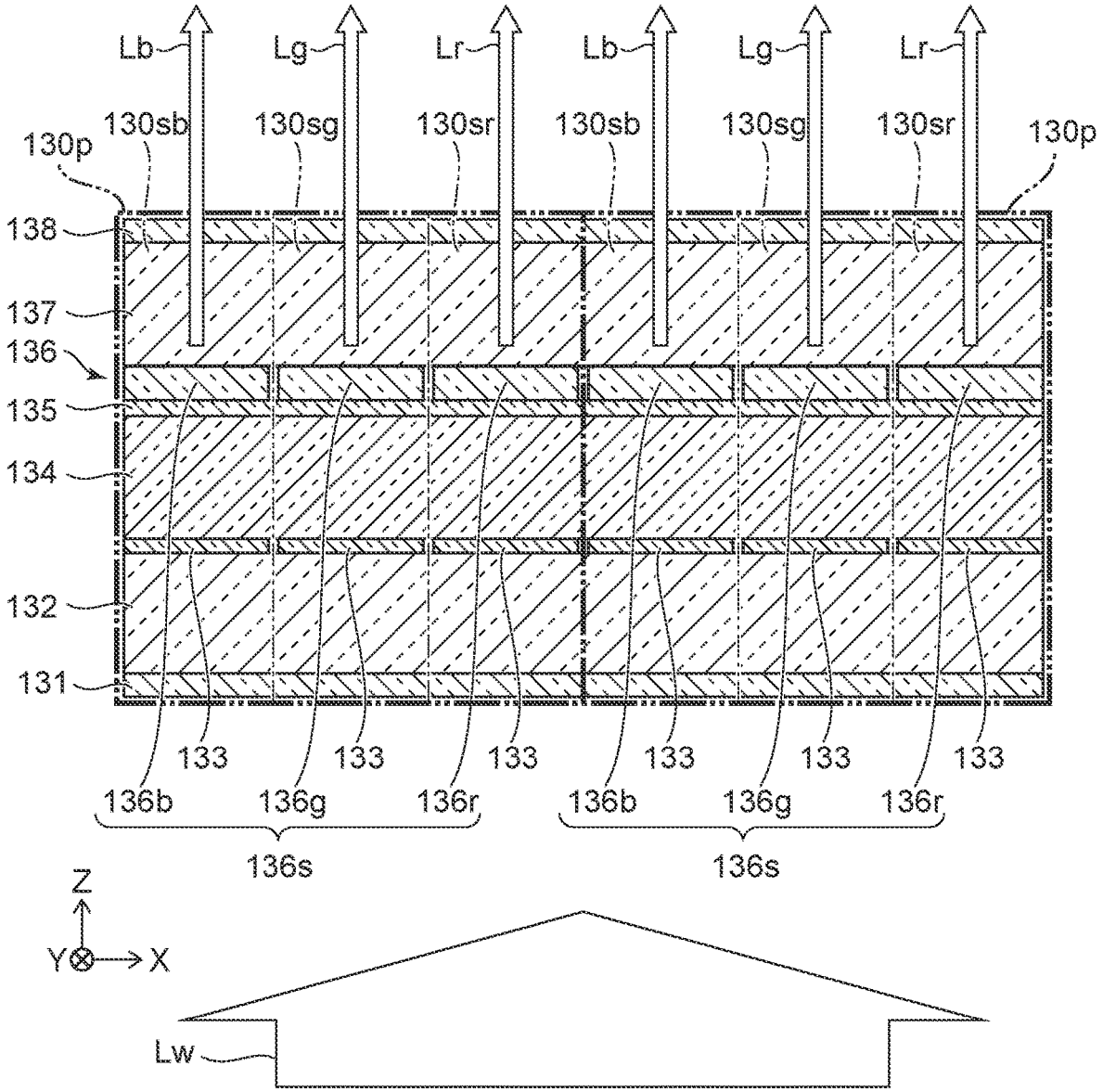
FIG. 5 illustrates a cross-sectional view of the liquid crystal panel along line V-V in FIG. 4.

FIG. 5 illustrates a cross-sectional view of the liquid crystal panel along line V-V in FIG. 4.

The liquid crystal panel 130 is located on the backlight 110. According to the present embodiment, as shown in FIG. 4, the liquid crystal panel 130 is substantially rectangular in top-view. According to the present embodiment, as shown in FIG. 5, the liquid crystal panel 130 includes a first polarizing plate 131, a first glass substrate 132, multiple individual electrodes 133, a liquid crystal layer 134, a common electrode 135, a color filter 136, a second glass substrate 137, and a second polarizing plate 138.

The first glass substrate 132 is located on the first polarizing plate 131. The multiple individual electrodes 133 are located on the first glass substrate 132. The multiple individual electrodes 133 are arranged in a matrix configuration in the X-direction and the Y-direction. The liquid crystal layer 134 is located on the multiple individual electrodes 133. The common electrode 135 is located on the liquid crystal layer 134.

The color filter 136 is located on the common electrode 135. According to the present embodiment, the color filter 136 includes a blue filter 136*b* that is configured to selectively transmit blue light Lb component of light Lw emitted from the light source 114, a green filter 136*g* that is configured to selectively transmit green light Lg component of the light Lw, and a red filter 136*r* that is configured to transmit red light Lr component of the light Lw. According to the present embodiment, filter sets 136*s* that each include one blue filter 136*b*, one green filter 136*g*, and one red filter 136*r* are arranged in a matrix configuration in the X-direction and the Y-direction. In each filter set 136*s*, one blue filter 136*b*, one green filter 136*g*, and one red filter 136*r* are arranged in this order in the X-direction. The filters 136*b*, 136*g*, and 136*r* are located at positions respectively overlapping three individual electrodes 133, respectively, in top-view.

The second glass substrate 137 is located on the color filter 136. The second polarizing plate 138 is located on the second glass substrate 137.

However, the specific configuration of the liquid crystal panel is not particularly limited to the configuration described above.

Hereinbelow, a portion of the liquid crystal panel 130 having one filter set 136*s*, a portion positioned directly above the one filter set 136*s*, and a portion positioned directly under the one filter set 136*s* is referred to as a "pixel 130*p*". Accordingly, according to the present embodiment, as shown in FIG. 4, the liquid crystal panel 130 includes multiple pixels 130*p* arranged in the matrix configuration in the X-direction and the Y-direction.

Hereinbelow, a portion of one pixel 130*p* having one blue filter 136*b*, a portion positioned directly above the one blue filter 136*b*, and a portion positioned directly under the one blue filter 136*b* is referred to as a "blue subpixel 130*sb*". The blue subpixel 130*sb* is configured to transmit blue light Lb. Similarly, a portion of one pixel 130*p* having one green filter 136*g*, a portion positioned directly above the one green filter 136*g*, and a portion positioned directly under the one green filter 136*g* is referred to as a "green subpixel 130*sg*". The green subpixel 130*sg* is configured to transmit green light Lg. Similarly, a portion of one pixel 130*p* having one red filter 136*r*, a portion positioned directly above the one red filter 136*r*, and a portion positioned directly under the one red filter 136*r* is referred to as a "red subpixel 130*sr*". The red subpixel 130*sr* is configured to transmit red light Lr.

The driver 140 for the liquid crystal panel can adjust light transmittance of the portions of the liquid crystal layer 134 positioned directly above the individual electrodes 133 by adjusting voltages applied between the common electrode 135 and the individual electrodes 133. The gradations of the pixels 130*p* of the liquid crystal panel 130, and more specifically, the gradations of the subpixels 130*sb*, 130*sg*, and 130*sr* are adjusted thereby.

The multiple pixels 130*p* are arranged in N2 rows and M2 columns. Here, N2 and M2 each are any integer such that N2>N1 and M2>M1. The multiple pixels 130*p* are located in the light-emitting regions 110*s* in top-view. Although in an example shown in FIG. 4, four pixels 130*p* correspond to one light-emitting region 110*s*, the number of the pixels 130*p* that correspond to one light-emitting region 110*s* may be less than four or more than four.

As shown in FIG. 1, the driver 140 for the liquid crystal panel is connected to the liquid crystal panel 130 and the controller 150. The driver 140 for the liquid crystal panel includes a drive circuit that drives the liquid crystal panel 130. The driver 140 for the liquid crystal panel adjusts the gradations of the pixels 130*p* according to liquid crystal panel control data SG2 received from the controller 150.

Figure 6:
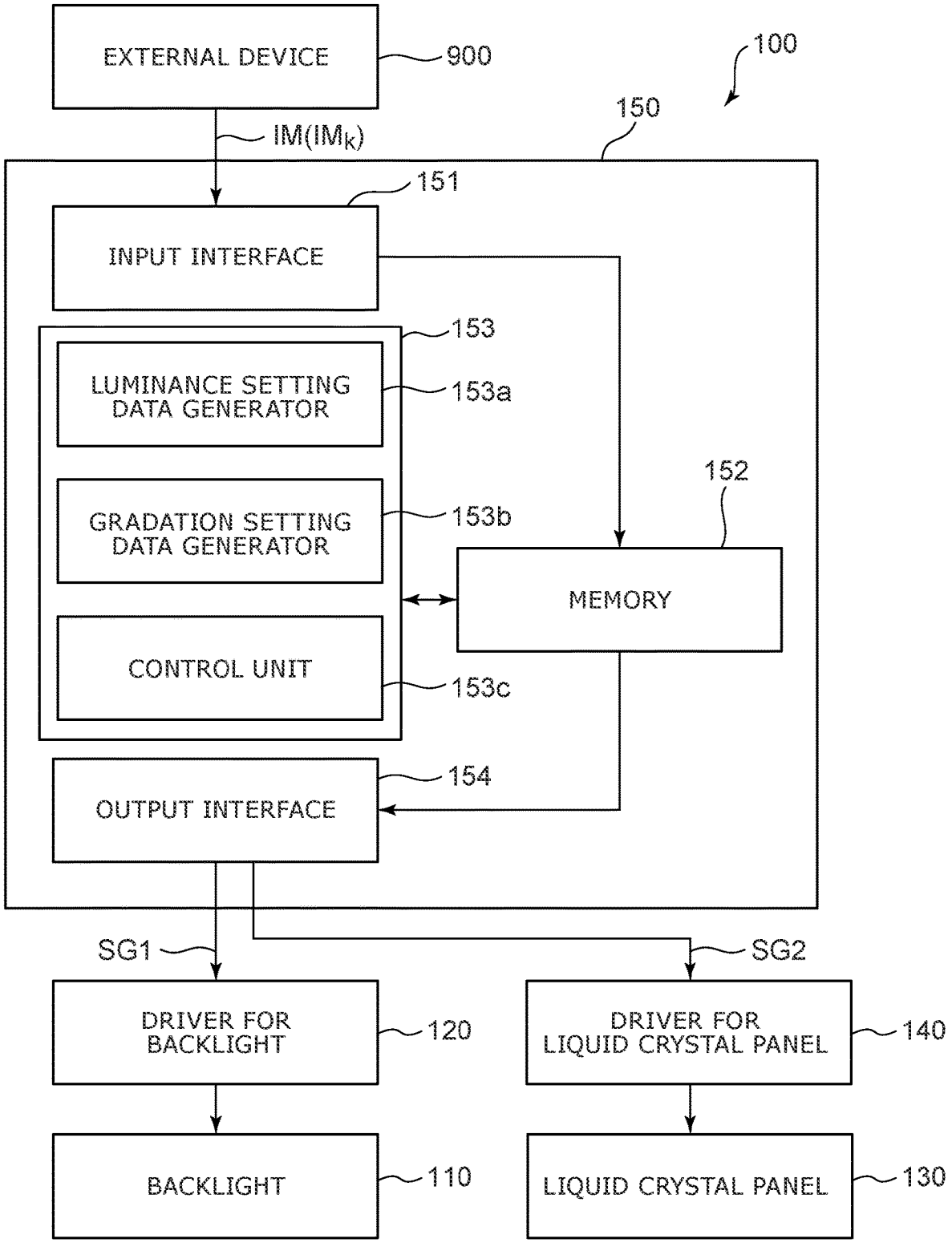
FIG. 6 is a block diagram showing components of the image display device according to the first embodiment.

FIG. 6 is a block diagram showing components of the image display device 100 according to the first embodiment.

According to the first embodiment, the controller 150 includes an input interface 151, memory 152, a processor 153 such as a CPU (central processing unit) or the like, and an output interface 154. These components are connected to each other by a bus.

For example, the input interface 151 is connected to an external device 900 such as a tuner, a personal computer, a game machine, etc. The input interface 151 includes, for example, a connection terminal to the external device 900 such as a HDMI® (High-Definition Multimedia Interface) terminal, etc. The external device 900 inputs an input image IM to the controller 150 via the input interface 151.

The memory 152 includes, for example, ROM (Read-Only Memory), RAM (Random-Access Memory), etc. The memory 152 stores various programs, various parameters, and various data for displaying an image in the liquid crystal panel.

By reading the programs stored in the memory 152, the processor 153 processes the input image IM, determines setting values of luminances of the light-emitting regions 110*s* of the backlight 110 and setting values of the gradations of the pixels 130*p* of the liquid crystal panel 130, and controls the backlight 110 and the liquid crystal panel 130 based on these setting values. Thereby, an image that corresponds to the input image IM is displayed on the liquid crystal panel 130. The processor 153 includes a luminance setting data generator 153*a*, a gradation setting data generator 153*b*, and a control unit 153*c*.

The output interface 154 is connected to the driver 120 for the backlight. Also, the output interface includes a connection terminal of the driver 140 for the liquid crystal panel such as a HDMI® terminal, etc., and is connected to the driver 140 for the liquid crystal panel. The driver 120 for the backlight receives the backlight control data SG1 via the output interface 154. The driver 140 for the liquid crystal receives the liquid crystal panel control data SG2 via the output interface 154.

An image display method that uses the image display device 100 according to the present embodiment will be described hereinafter. Functions of the processor 153 as the luminance setting data generator 153*a*, the gradation setting data generator 153*b*, and the control unit 153*c* also will be described.

Figure 7:
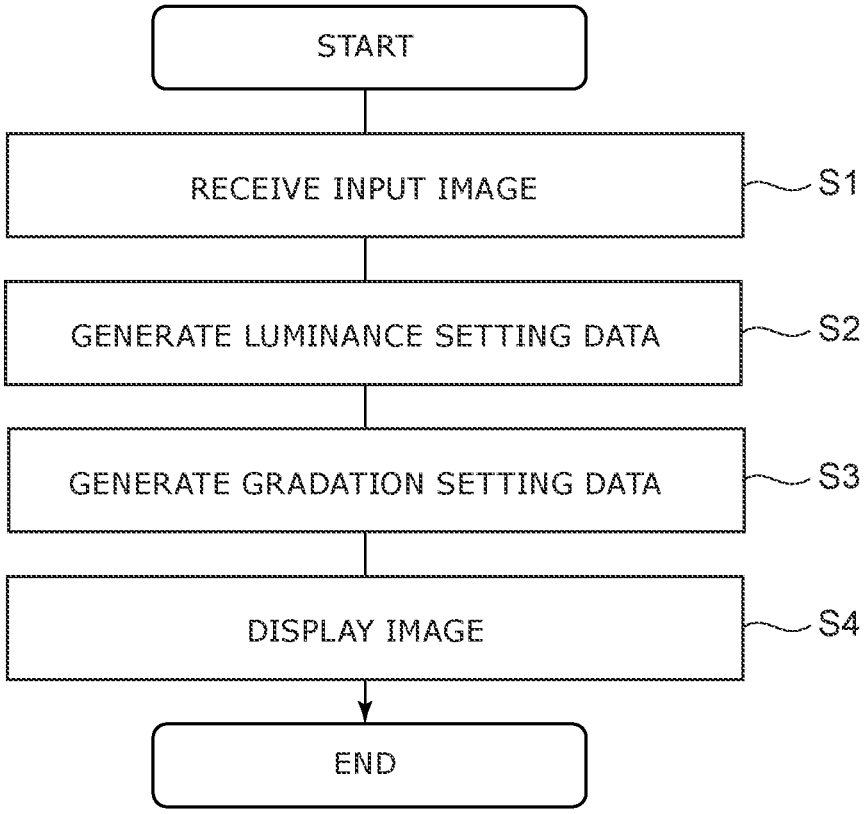
FIG. 7 is a flowchart showing an image display method according to the first embodiment.

FIG. 7 is a flowchart showing the image display method according to the first embodiment.

According to the first embodiment, the multiple continuous input images IM are input to the controller 150. The image display method according to the first embodiment includes an reception process S1 of the input image IM, a generation process S2 of luminance setting data D2, a generation process S3 of gradation setting data D3, and a display process S4 of an image corresponding to the input image IM, for each of the multiple input images IM.

The processes will now be elaborated. A method of displaying, on the liquid crystal panel 130, an image that corresponds to the kth input image $IM_k$ (a first input image) among the multiple input images IM will now be described. Here, k is any natural number.

First, the reception process S1 of the input image $IM_k$ will be described.

First, as shown in FIG. 6, the input interface 151 of the controller 150 receives the input image $IM_k$ from the external device 900. The received input image $IM_k$ is stored in the memory 152.

Figure 8:
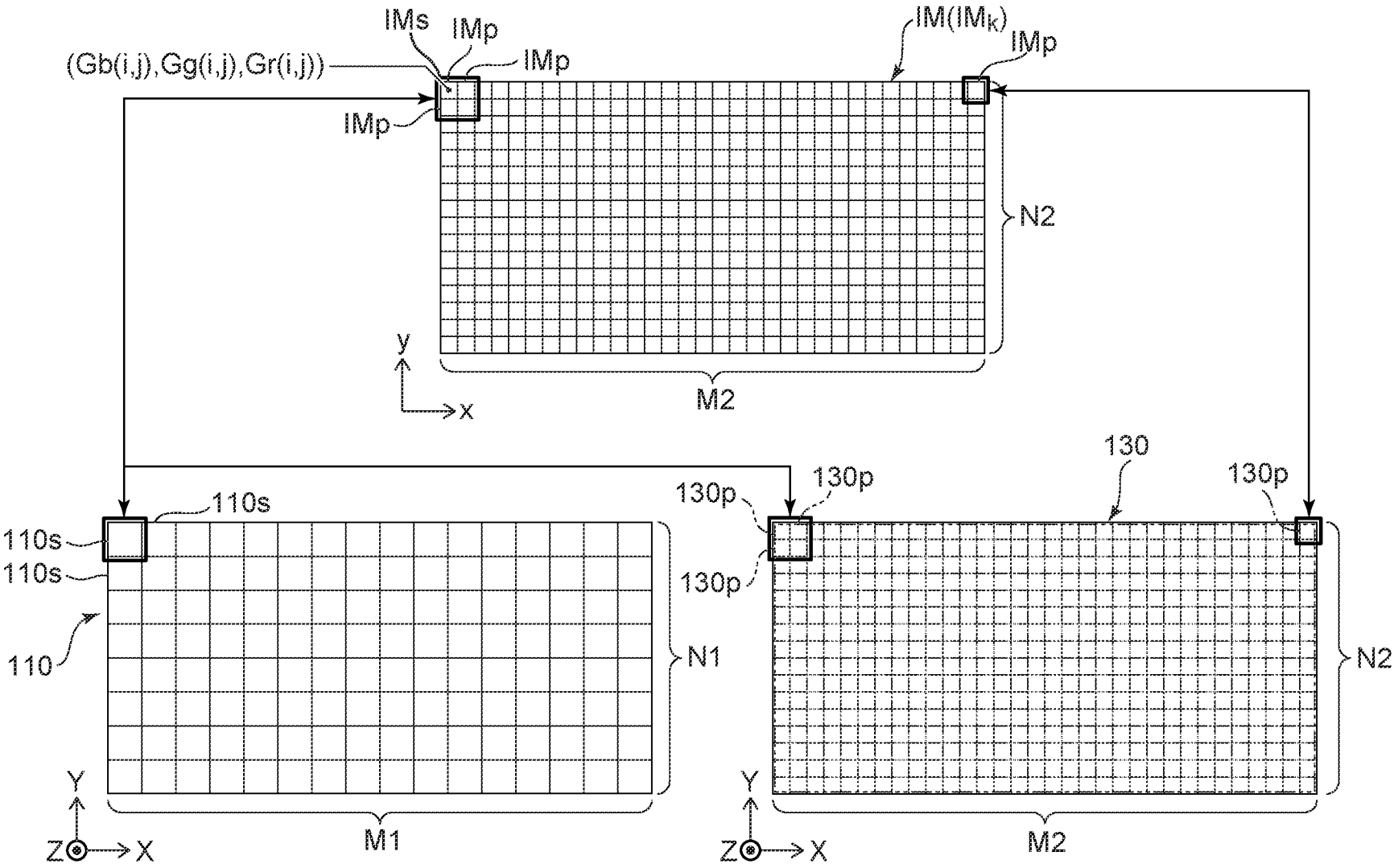
FIG. 8 is a schematic diagram showing a relationship among pixels of the liquid crystal panel, light-emitting regions of the backlight, and pixels of an input image input to the image display device according to the first embodiment.

FIG. 8 is a schematic diagram showing a relationship among the pixels of the liquid crystal panel, the light-emitting regions of the backlight, and pixels of the input image input to the controller of the image display device according to the first embodiment.

Each input image IM includes multiple pixels (may be referred to as "image pixels") IMp arranged in a matrix configuration. For easier understanding of the following description, the arrangement directions of the elements are represented using a xy orthogonal coordinate system for data in which elements such as the pixels IMp or the like are arranged in a matrix configuration as in the input image IM. The x-axis direction in the direction of the arrow is referred to as the "+x direction"; and the opposite direction is referred to as the "−x direction". Similarly, the y-axis direction in the direction of the arrow is referred to as the "+y direction"; and the opposite direction is referred to as the "−y direction". Hereinbelow, the element groups of the matrix that are arranged in the x-direction are referred to a "row"; and the element groups of the matrix that are arranged in the y-direction are referred to a "column". For example, as shown in FIG. 8, the row that is positioned furthest in the +y direction (the row positioned uppermost when viewed according to a direction of reference numerals) is referred to as the "first row"; and the row that is positioned furthest in the −y direction (the row positioned lowermost when viewed according to the direction of reference numerals) is referred to as the "final row". Similarly, as shown in FIG. 8, the column that is positioned furthest in the −x direction (the column positioned leftmost when viewed according to the direction of reference numerals) is referred to as the "first column"; and the column that is positioned furthest in the +x direction (the column positioned rightmost when viewed according to the direction of reference numerals) is referred to as the "final column".

For easier understanding of the following description, an example is described in which one pixel IMp of the input image IM corresponds to one pixel 130*p* of the liquid crystal panel 130. In other words, according to the present embodiment, the multiple pixels IMp are arranged in N2 rows and M2 columns. Then, the multiple pixels IMp are included in an area IMs of the input image IM that corresponds to one light-emitting region 110*s* of the backlight 110. However, the correspondence between the pixels of the input image and the pixels of the liquid crystal panel may not be one-to-one. In such a case, the processor 153 of the controller 150 performs the following processing after performing preprocessing of the input image so that the pixels of the input image and the pixels of the liquid crystal panel correspond one-to-one.

A gradation value is set to each of the pixels IMp. According to the present embodiment, the input image IM is a color image. Therefore, a blue gradation Gb(i, j), a green gradation Gg(i, j), and a red gradation Gr(i, j) are set for a pixel IMp at the ith row and the jth column. Here, i is any integer from 1 to N2, and j is any integer from 1 to M2. The gradation values Gb(i, j), Gg(i, j), and Gr(i, j) are, for example, numerals from 0 to 255 when represented by 8 bits.

The generation process S2 of the luminance setting data D2 will now be described.

Figure 9:
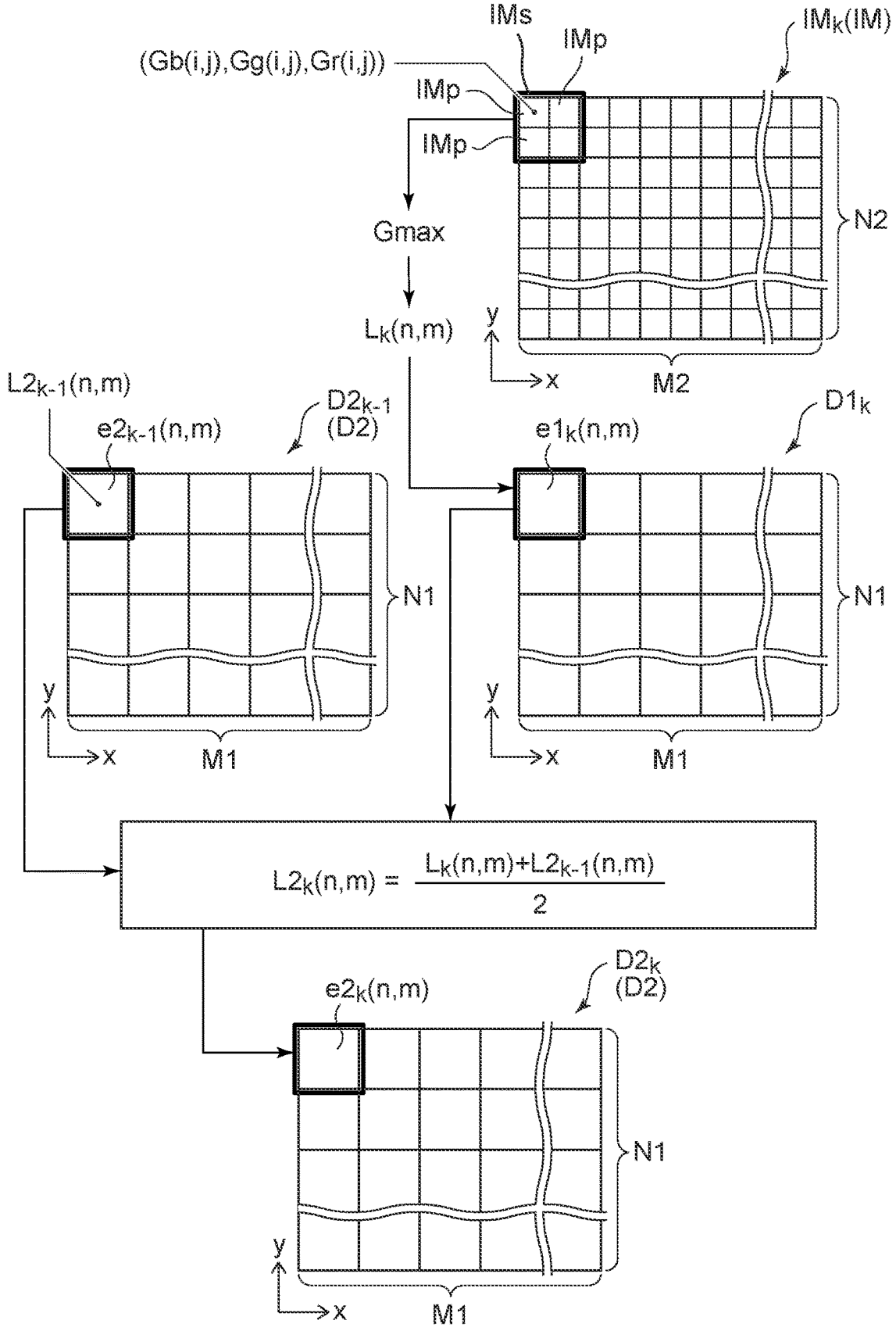
FIG. 9 is a schematic diagram showing a process of generating luminance setting data in the image display method according to the first embodiment.

FIG. 9 is a schematic diagram showing a process of generating the luminance setting data in the image display method according to the first embodiment.

Hereinbelow, the luminance setting data D2 that is generated for the kth input image $IM_k$ also is referred to as luminance setting data $D2_k$. The luminance setting data generator 153*a* generates the luminance setting data $D2_k$ in which the setting values of the luminances of the light-emitting regions 110*s* of the backlight 110 are set.

A specific method of the process of generating the luminance setting data $D2_k$ will now be described.

First, the luminance setting data generator 153*a* generates luminance data $D1_k$ including a luminance $L_k(n, m)$ converted from a maximum gradation Gmax with respect to each area IMs of the input image $IM_k$, wherein each area IMs correspond to the light-emitting region 110*s*.

Specifically, first, the luminance setting data generator 153*a* determines an area IMs that corresponds to the light-emitting region 110*s* positioned at the nth row and the mth column. Then, the luminance setting data generator 153*a* determines the maximum value of the blue gradation Gb(i, j), the green gradation Gg(i, j), and the red gradation Gr(i, j) of all of the pixels IMp included in the area IMs to be the maximum gradation Gmax of the area IMs. Then, the luminance setting data generator 153*a* converts the maximum gradation Gmax into the luminance $L_k(n, m)$. Then, the luminance setting data generator 153*a* uses the luminance $L_k(n, m)$ as a luminance value of an element $e1_k(n, m)$ at the nth row and the mth column in the luminance data $D1_k$. Here, n is any integer from 1 to N1, and m is any integer from 1 to M1.

The luminance setting data generator 153*a* performs this processing for all of the areas IMs.

The luminance data $D1_k$ thus obtained is data of a matrix configuration that includes N1 rows and M1 columns. The luminance value of the element $e1_k(n, m)$ in the luminance data $D1_k$ at the nth row and the mth column is converted from the maximum gradation Gmax of the area IMs at the nth row and the mth column and is a tentatively-set luminance value of the nth row and the mth column.

The luminance setting data generator 153*a* stores the luminance data $D1_k$ in the memory 152.

When the controller 150 changes the setting value of the luminance of some light-emitting region 110*s* to switch the image displayed on the liquid crystal panel 130, the amount of the light from the light-emitting element 114*a* changes more quickly than the amounts of the light from the green phosphor 114*g* and the red phosphor 114*r*. Also, there are cases where response speeds of the green phosphor 114*g* and the red phosphor 114*r* are different from each other. For example, when a response speed of the red phosphor 114*r* is slower than a response speed of the green phosphor 114*g*, and when the controller 150 increases the setting value of the luminance of the light-emitting region 110*s*, the amounts of the light from the light-emitting element 114*a* and the green phosphor 114*g* increase more quickly than the light amount of the light from the red phosphor 114*r*; therefore, the light Lw that is emitted from the light source 114 when increasing the luminance has a greenish-blue (cyan)-ish color. Also, when the controller 150 reduces the setting value of the luminance of the light-emitting region 110*s*, the amount of the light from the red phosphor 114*r* decreases more slowly than the amounts of the light from the light-emitting element 114*a* and the green phosphor 114*g*; therefore, the light Lw that is emitted from the light source 114 when reducing the luminance has a reddish color.

In such a manner, when the setting value of the luminance of the light-emitting region 110*s* is changed, the proportion of the amount of the blue light Lb, the amount of the green light Lg, and the amount of the red light Lr included in the light Lw changes. The color balance of the light Lw is degraded thereby. Such degradation of the color balance of the light Lw becomes highly noticeable as the change amount of the setting value of the luminance of the light-emitting region 110*s* increases. Conventionally, the controller controls the backlight 110 based on the luminance data $D1_k$ generated based on the input image $IM_k$. For that reason, the change amount of the luminance of the light-emitting region 110*s* is significantly large that the degradation of the color balance of the light Lw is highly noticeable.

To address such an issue, in the image display method according to the present embodiment, a setting value $L2_k(n, m)$ of the luminance of the luminance setting data $D2_k$ for the input image $IM_k$ is determined based on an average value of the luminance $L_k(n, m)$ of the luminance data $D1_k$ and the setting value $L2_{k-1}(n, n)$ of the luminance of luminance setting data $D2_{k-1}$ (a second input image) generated for the (k−1)th input image $IM_{k-1}$.

Specifically, first, the luminance setting data generator 153*a* calculates the average value of the luminance $L_k(n, m)$ of the element $e1_k(n, m)$ at the nth row and the mth column of the luminance data $D1_k$ and the setting value $L2_{k-1}(n, m)$ of the luminance of an element $e2_{k-1}(n, m)$ at the nth row and the mth column of the luminance setting data $D2_{k-1}$. Then, the luminance setting data generator 153*a* determines the average value to be the value of an element $e2_k(n, m)$ at the nth row and the mth column of the luminance setting data $D2_k$, i.e., the setting value $L2_k(n, m)$ of the luminance of the light-emitting region 110*s* positioned at the nth row and the mth column.

The luminance setting data generator 153*a* performs this processing for all of the light-emitting regions 110*s* of the backlight 110.

The luminance setting data $D2_k$ thus obtained is data of a matrix configuration that includes N1 rows and M1 columns. The value of the element $e2_k(n, m)$ of the luminance setting data $D2_k$ at the nth row and the mth column is the setting value $L2_k(n, m)$ of the luminance of the light-emitting region 110*s* positioned at the nth row and the mth column of the backlight 110.

The luminance setting data generator 153*a* stores the luminance setting data $D2_k$ in the memory 152.

The luminance setting data $D2_{k-1}$ that is generated for the (k−1)th input image $IM_{k-1}$ is pre-generated by the luminance setting data generator 153*a* and stored in the memory 152. When an input image $IM_{k-2}$ that is immediately before the (k−1)th exists, the luminance setting data generator 153*a* generates the luminance setting data $D2_{k-1}$ in a manner similar to the method for generating the luminance setting data $D2_k$. When the input image $IM_{k-2}$ that is immediately before the (k−1)th does not exist, that is, when the input image $IM_{k-1}$ is the first input image, the luminance setting data generator 153*a* may use the luminance data generated based on the input image $IM_{k-1}$ as the luminance setting data $D2_{k-1}$.

The generation process S3 of the gradation setting data D3 will now be described.

Figure 10:
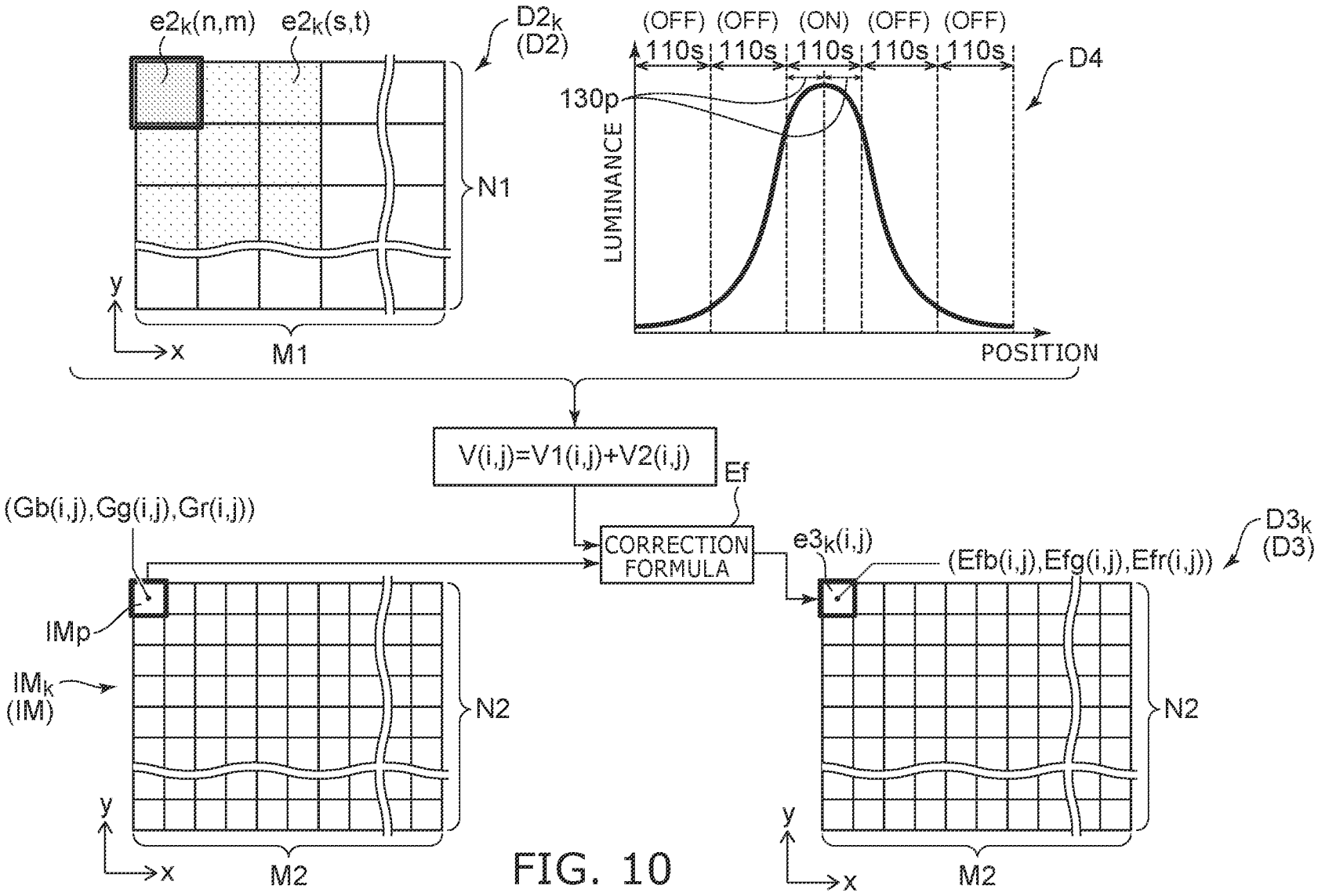
FIG. 10 is a schematic diagram showing a process of generating gradation setting data in the image display method according to the first embodiment.

FIG. 10 is a schematic diagram showing a process of generating gradation setting data in the image display method according to the first embodiment.

Hereinbelow, gradation setting data D3 that is generated for the kth input image $IM_k$ is referred to as the "gradation setting data $D3_k$". The gradation setting data generator 153*b* generates the gradation setting data $D3_k$ in which the setting values of the gradations of the pixels 130*p* of the liquid crystal panel 130 are set based on the input image $IM_k$ and the luminance setting data $D2_k$.

A specific example of the process of generating the gradation setting data $D3_k$ will now be described.

According to the present embodiment, the memory 152 pre-stores luminance distribution data D4 that indicates luminance distribution in the XY plane when the light source 114 corresponding to one light-emitting region 110*s* is lit. In FIG. 10, the light-emitting region 110*s* in which the light source 114 is lit is shown as ON, and the light-emitting regions 110*s* in which the light sources 114 are unlit are shown as OFF.

Although the setting values of the luminances of the light-emitting regions 110*s* of the backlight 110 are determined in the process S2, actual luminance may be different in the XY plane even in one light-emitting region 110*s* as shown in the luminance distribution data D4 in FIG. 10. Also, when the light source 114 corresponding to one light-emitting region 110*s* is lit, the light may propagate to neighboring light-emitting regions 110*s* at the periphery of the one light-emitting region 110*s*.

To address this issue, first, the gradation setting data generator 153*b* estimates a luminance value V(i, j) directly under the pixel 130*p* positioned at the ith row and the jth column of the liquid crystal panel 130 from the luminance setting data $D2_k$ and the luminance distribution data D4.

Specifically, the gradation setting data generator 153*b* estimates a luminance value V1(*i, j*) of the luminance setting data $D2_k$ directly under the pixel 130*p* when only the light source 114 in the light-emitting region 110*s* positioned directly under the pixel 130*p* is lit from the value of the element $e2_k$(n, m) (the setting value of the luminance) corresponding to the light-emitting region 110*s* and the luminance distribution data D4. Furthermore, the gradation setting data generator 153*b* estimates a luminance value V2(*i, j*) of the luminance setting data $D2_k$ directly under the pixel 130*p* when only the light sources 114 in the light-emitting regions 110*s* at the periphery are lit from the value of the element $e2_k$(s, t) corresponding to the light-emitting regions 110*s* at the periphery of the light-emitting region 110*s* and the luminance distribution data D4. Then, the sum of the luminance values V1(*i, j*) and V2(*i, j*) is estimated to be the luminance value V(i, j) directly under the pixel 130*p*. Thereby, the gradation setting data generator 153*b* can estimate the luminance value V(i, j) directly under the pixel 130*p* by including both the luminance distribution in the one light-emitting region 110*s* and the light leakage from the neighboring light-emitting regions 110*s*.

Then, the gradation setting data generator 153*b* inputs the estimated luminance value V(i, j) and the blue gradation Gb(i, j) of the pixel IMp corresponding to the pixel 130*p* for the input image $IM_k$ to a correction formula Ef. The correction formula Ef is, for example, a correction formula that converts a luminance value into a gradation value based on gamma correction, and corrects a gradation value of the input image $IM_k$ by using the converted gradation value. The gradation setting data generator 153*b* uses an output value Efb(i, j) of the correction formula Ef generated by inputting the blue gradation Gb(i, j) to the correction formula Ef as the setting value of the blue gradation of the pixel 130*p*. Similar processing is performed also for the green gradation Gg(i, j); and an output value Efg(i, j) of the correction formula Ef obtained thereby is used as the setting value of the green gradation of the pixel 130*p*. The gradation setting data generator 153*b* performs similar processing also for the red gradation Gr(i, j); and an output value Efr(i, j) of the correction formula Ef obtained thereby is used as the setting value of the red gradation of the pixel 130*p*. In other words, the gradation setting data generator 153*b* uses the output values Efb(i, j), Efg(i, j), and Efr(i, j) as the value of an element $e3_k$(i, j) at the ith row and the jth column of the gradation setting data $D3_k$.

The gradation setting data generator 153*b* performs this processing for each pixel 130*p*(i, j) of the liquid crystal panel 130. The gradation setting data $D3_k$ is generated thereby. Thus, according to the present embodiment, the input image $IM_k$ is modified using the luminance setting data $D2_k$. The gradation setting data D3 is generated based on the modified input image.

The gradation setting data $D3_k$ thus obtained is data of a matrix configuration of N2 rows and M2 columns. The three values Efb(i, j), Efg(i, j), and Efr(i, j) of the element $e3_k$(i, j) at the ith row and the jth column of the gradation setting data D3 correspond respectively to the setting value of the blue gradation, the setting value of the green gradation, and the setting value of the red gradation of the pixel 130*p* positioned at the ith row and the jth column of the liquid crystal panel 130.

The gradation setting data generator 153*b* stores the gradation setting data $D3_k$ in the memory 152.

Although an example of the process of generating the gradation setting data D3 is described above, the process of generating the gradation setting data is not limited to the one described above. For example, the luminance values may be input to the conversion formula after estimating the luminance values directly under all of the pixels of the liquid crystal panel.

The display process S4 of the image will now be described.

The control unit 153*c* causes the liquid crystal panel 130 to display the image by controlling the backlight 110 based on the luminance setting data $D2_k$ and by controlling the liquid crystal panel 130 based on the gradation setting data $D3_k$.

Specifically, as shown in FIG. 6, the control unit 153*c* transmits the backlight control data SG1 generated based on the luminance setting data D2 to the driver 120 for the backlight via the output interface 154. The backlight control data SG1 is, for example, data of a PWM (Pulse Width Modulation) format but is not particularly limited as long as the driver 120 for the backlight can operate based on the data. The driver 120 for the backlight controls the light emission of the light sources 114 based on the backlight control data SG1.

Also, the control unit 153*c* transmits the gradation setting data $D3_k$ to the driver 140 for the liquid crystal panel as the liquid crystal panel control data SG2 via the output interface 154. Alternatively, the liquid crystal panel control data SG2 may be data in a format converted from the gradation setting data $D3_k$ such that the driver 140 for the liquid crystal panel can operate. The driver 140 for the liquid crystal panel controls the pixels 130*p*, and more specifically, the light transmittance of the subpixels 130*sb*, 130*sg*, and 130*sr* based on the liquid crystal panel control data SG2.

The timing of converting the luminance setting data $D2_k$ into the backlight control data SG1 is not particularly limited as long as the timing is in or after the process S2. When converting the gradation setting data $D3_k$ into the liquid crystal panel control data SG2, the timing of the conversion is not particularly limited as long as the timing is in or after the process S3.

Effects of the first embodiment will now be described.

The image display method according to the first embodiment includes: the process S2 of generating the luminance setting data $D2_k$ for the input image $IM_k$ among the multiple input images IM; a process of generating the luminance data $D1_k$ including the maximum gradation Gmax of each area IMs of the input image $IM_k$ as the luminance $L_k(n, m)$ for the areas IMs that correspond to the light-emitting regions 110*s* of the backlight 110; and a process of determining the setting value $L2(n, m)$ of the luminance of the luminance setting data $D2_k$ of each light-emitting region 110*s* based on the average value of the luminance $L_k(n, m)$ of areas IMs of the luminance data $D1_k$ and the setting value $L2_{k-1}(n, m)$ of the luminance of each light-emitting region 110*s* of the luminance setting data $D2_{k-1}$ generated for the input image $IM_{k-1}$ that is immediately before the input image $IM_k$ among the multiple input images IM.

As a result, a significant luminance difference between the setting value $L2_k$ of the luminance of each light-emitting region 110*s* for the input image $IM_k$ and the setting value $L2_{k-1}$ of the luminance of each light-emitting region 110*s* for the input image $IM_{k-1}$ immediately before the input image $IM_k$ can be suppressed. A significant change in the luminances of the light-emitting regions 110*s* when switching the image displayed on the liquid crystal panel 130 can be suppressed thereby. Thus, an image display method can be provided in which the degradation of the color balance of the light Lw emitted from the backlight 110 can be reduced.

Second Embodiment

A second embodiment will now be described.

Figure 11:
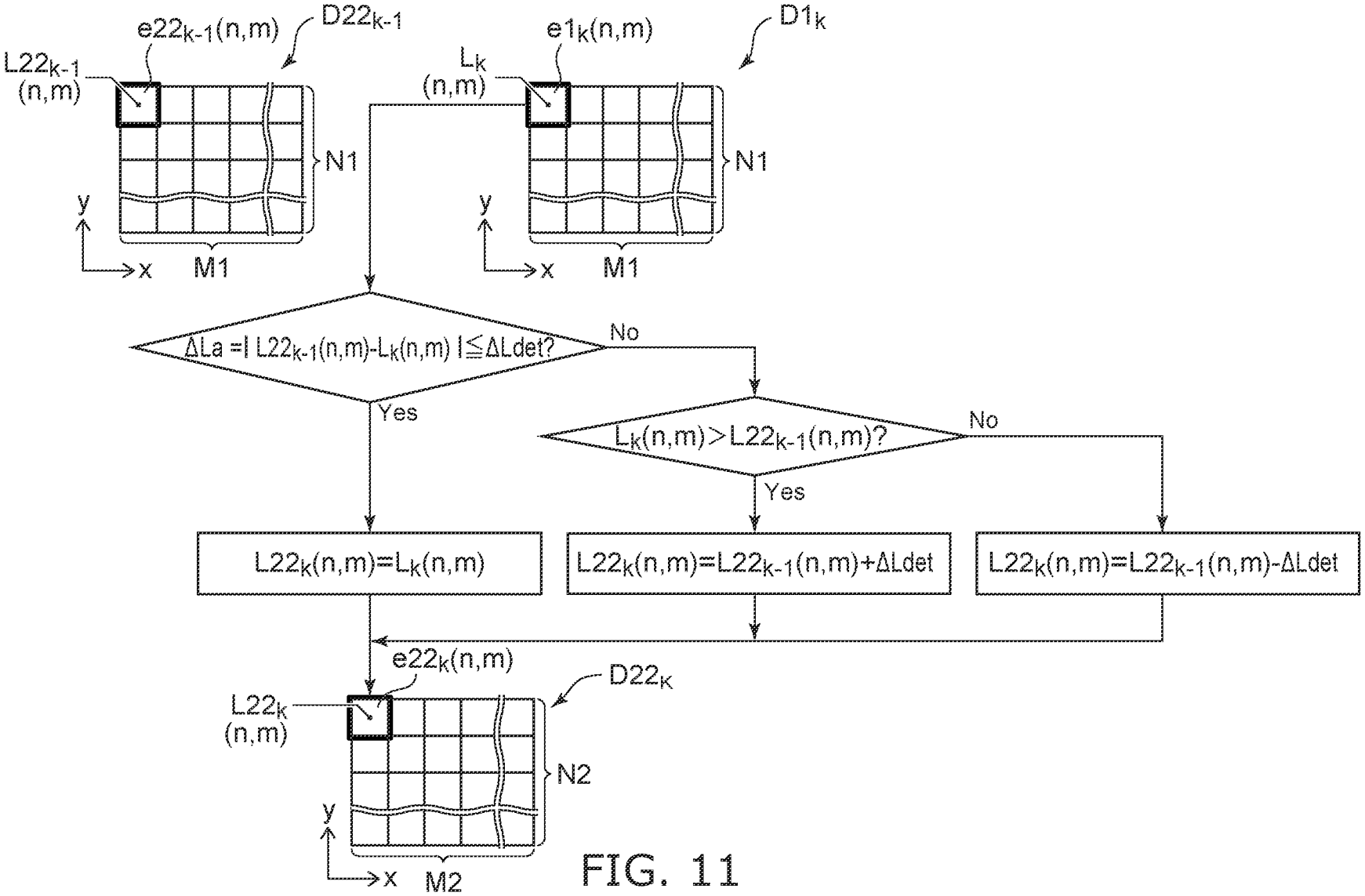
FIG. 11 is a schematic diagram showing a process of generating luminance setting data in an image display method according to a second embodiment.
Figure 12A:
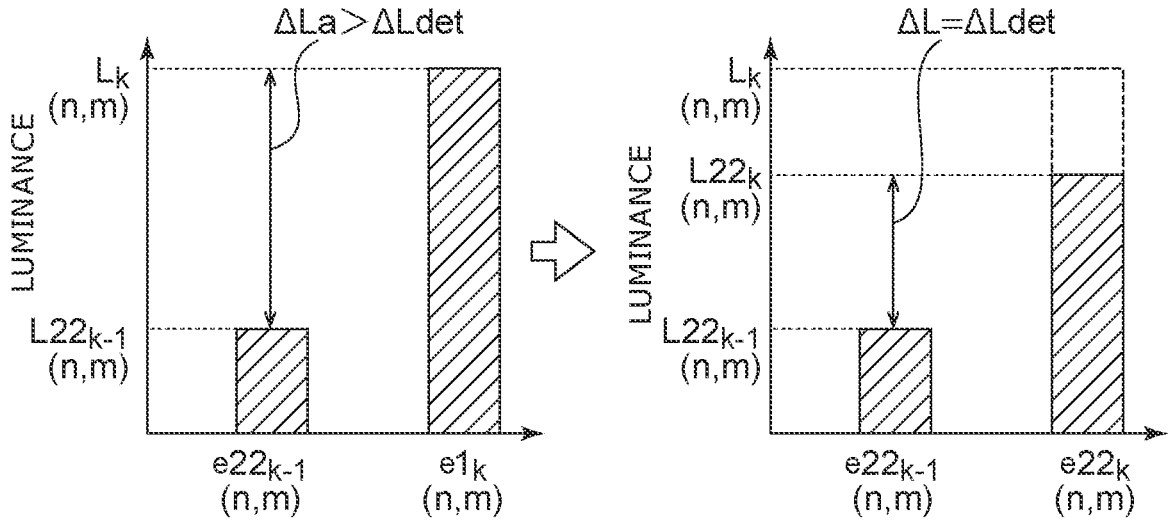
FIGS. 12A and 12B are schematic diagrams showing the process of generating the luminance setting data when a difference of a luminance value is greater than a threshold value in the second embodiment.
Figure 12B:
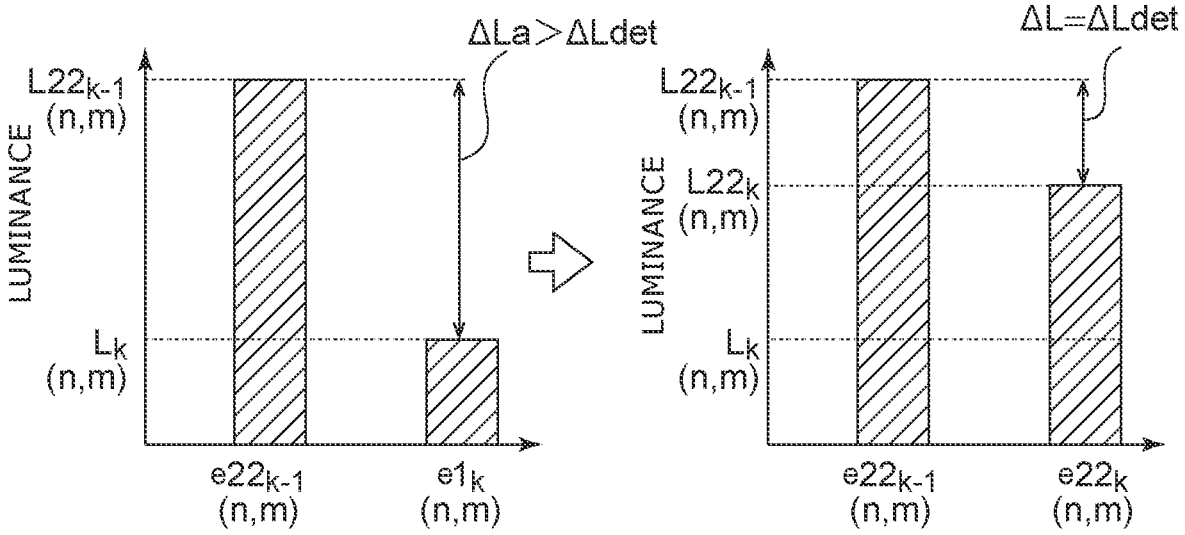

FIG. 11, FIG. 12A, and FIG. 12B are schematic diagrams showing a process of generating the luminance setting data in the image display method according to the second embodiment.

The generation process S2 of luminance setting data $D22_k$ in the image display method according to the second embodiment is different from that in the image display method according to the first embodiment.

As a general rule in the following description, only differences from the first embodiment are described. Other than aspects described below, the second embodiment is similar to the first embodiment. This is similar for the other embodiments described below as well.

The generation process S2 of the luminance setting data $D22_k$ for the kth input image $IM_k$ will now be described.

As shown in FIGS. 12A and 12B, the luminance setting data generator 153*a* determines, for each of light-emitting regions 110*s* of the backlight 110, a setting value $L22_k(n, m)$ of the luminance of the light-emitting region 110 for the input image $IM_k$ so that a luminance difference ΔL from a setting value $L22_{k-1}(n, m)$ of the luminance of luminance setting data $D22_{k-1}$ generated for the (k−1)th input image $IM_{k-1}$ immediately before the kth input image $IM_k$ is within a threshold ΔLdet.

Specifically, first, as shown in FIG. 11, the luminance setting data generator 153*a* generates the luminance data $D1_k$ based on the input image $IM_k$ in a manner similar to that is the first embodiment.

Then, the luminance setting data generator 153*a* calculates a difference ΔLa between the luminance $L_k(n, m)$ of the element $e1_k(n, m)$ p at the nth row and the mth column of the luminance data $D1_k$ and the setting value $L22_{k-1}(n, m)$ of the luminance of an element $e22_{k-1}(n, m)$ at the nth row and the mth column of the luminance setting data $D22_{k-1}$ generated for the (k−1)th input image $IM_{k-1}$.

Next, the luminance setting data generator 153*a* determines whether or not the difference ΔLa is not more than the threshold ΔLdet.

When the difference ΔLa is determined to be not more than the threshold ΔLdet, the luminance setting data generator 153*a* uses the luminance $L_k(n, m)$ of the element $e1_k(n, m)$ at the nth row and the mth column of the luminance data $D1_k$ as the value of an element $e22_k(n, m)$ at the nth row and the mth column of the luminance setting data $D22_k$, i.e., the setting value $L22_k(n, m)$ of the luminance of the light-emitting region 110*s* positioned at the nth row and the mth column.

When the difference ΔLa is determined to be more than the threshold ΔLdet, the luminance setting data generator 153*a* determines whether or not the luminance $L_k(n, m)$ is greater than the setting value $L22_{k-1}(n, m)$ of the luminance.

When the luminance $L_k(n, m)$ is determined to be greater than the setting value $L22_{k-1}(n, m)$ of the luminance, the luminance setting data generator 153*a* uses a sum of the threshold ΔLdet and the setting value $L22_{k-1}(n, m)$ of the luminance as the value of the element $e22_k(n, m)$ at the nth row and the mth column of the luminance setting data $D22_k$, i.e., the setting value $L22_k(n, m)$ of the luminance of the light-emitting region 110*s* at the nth row and the mth column as shown in FIGS. 11 and 12A.

When the luminance $L_k(n, m)$ is determined to be not greater than the setting value $L22_{k-1}(n, m)$ of the luminance, the luminance setting data generator 153*a* uses the setting value $L22_{k-1}(n, m)$ of the luminance minus the threshold ΔLdet as the value of the element $e22_k(n, m)$ at the nth row and the mth column of the luminance setting data $D22_k$, i.e., the setting value $L22_k(n, m)$ of the luminance of the light-emitting region 110*s* positioned at the nth row and the mth column as shown in FIGS. 11 and 12B.

The luminance setting data generator 153*a* performs this processing for all of the light-emitting regions 110*s* of the backlight 110. The luminance setting data $D22_k$ is generated thereby.

The generation process of the luminance setting data is not limited to the process described above. In the above example, the luminance setting data generator 153*a* determines the relationship between the luminance $L_k(n, m)$ and the setting value $L22_{k-1}(n, m)$ of the luminance by determining whether or not the luminance $L_k(n, m)$ is greater than the setting value $L22_{k-1}(n, m)$ of the luminance. However, the process of determining the relationship between the luminance $L_k(n, m)$ and the setting value $L22_{k-1}(n, m)$ of the luminance is not limited to the process described above. For example, the luminance setting data generator 153*a* may determine whether or not the luminance $L_k(n, m)$ is less than the setting value $L22_{k-1}(n, m)$ of the luminance.

In the image display method according to the second embodiment as described above, the process S2 of generating the luminance setting data $D22_k$ for the input image $IM_k$ among the multiple input images IM includes determining, for light-emitting regions 110*s* of the backlight 110, the setting value $L22_k(n, m)$ of the luminance of each light-emitting region 110*s* so that the luminance difference ΔL from the setting value $L22_{k-1}(n, m)$ of the luminance of the luminance setting data $D22_{k-1}$ generated for the input image $IM_{k-1}$ that is immediately before the input image $IM_k$ among the multiple input images IM is within the threshold ΔLdet. As a result, the change amount of the luminances of the light-emitting regions 110*s* when switching the image displayed on the liquid crystal panel 130 can be within the threshold ΔLdet. Thus, an image display method can be provided in which the degradation of the color balance of the light Lw can be reduced.

Also, the process S2 of generating the luminance setting data $D22_k$ for the input image $IM_k$ includes generating the luminance data $D1_k$ including the luminance $L_k(n, m)$ converted from the maximum gradation Gmax for each area IMs of the input image $IM_k$ that corresponds to one of the light-emitting regions 110*s* of the backlight 110. Then, the luminance $L_k(n, m)$ of the luminance data $D1_k$ is used as the setting value $L22_k(n, m)$ of the luminance of the light-emitting region 110*s* for each of the light-emitting regions 110*s* for which the difference ΔLa between the luminance $L_k(n, m)$ of the luminance data $D1_k$ and the setting value $L22_{k-1}(n, m)$ of the luminance of the luminance setting data $D22_{k-1}$ generated for the input image $IM_{k-1}$ is within the threshold ΔLdet.

The setting value $L22_{k-1}(n, m)$ of the luminance of the luminance setting data $D22_{k-1}$ generated for the input image $IM_{k-1}$ minus the threshold ΔLdet is used as the setting value $L22_k(n, m)$ of the luminance of the light-emitting region 110*s* for each of the light-emitting regions 110*s* of the backlight 110 for which the difference ΔLa is greater than the threshold ΔLdet and the luminance L(n, m) of the luminance data $D1_k$ is less than the setting value $L22_{k-1}$ of the luminance of the luminance setting data $D22_{k-1}$ generated for the input image $IM_{k-1}$.

The setting value $L22_{k-1}(n, m)$ of the luminance of the luminance setting data $D22_{k-1}$ generated for the input image $IM_{k-1}$ plus the threshold ΔLdet is used as the setting value $L22_k(n, m)$ of the luminance of the light-emitting region 110*s* for each of the light-emitting regions 110*s* of the backlight 110 for which the difference ΔLa is greater than the threshold ΔLdet and the luminance $L_k(n, m)$ of the luminance data $D1_k$ is greater than the setting value $L22_{k-1}(n, m)$ of the luminance of the luminance setting data $D22_{k-1}$ generated for the input image $IM_{k-1}$.

In such a manner, the luminance difference ΔL between the setting value $L22_k(n, m)$ of the luminance of the luminance setting data $D22_k$ generated for the input image $IM_k$ and the setting value $L22_{k-1}(n, m)$ of the luminance of the luminance setting data $D22_k$ generated for the input image $IM_{k-1}$ immediately before the input image $IM_k$ can be within the threshold ΔLdet.

Third Embodiment

A third embodiment will now be described.

Figure 13:
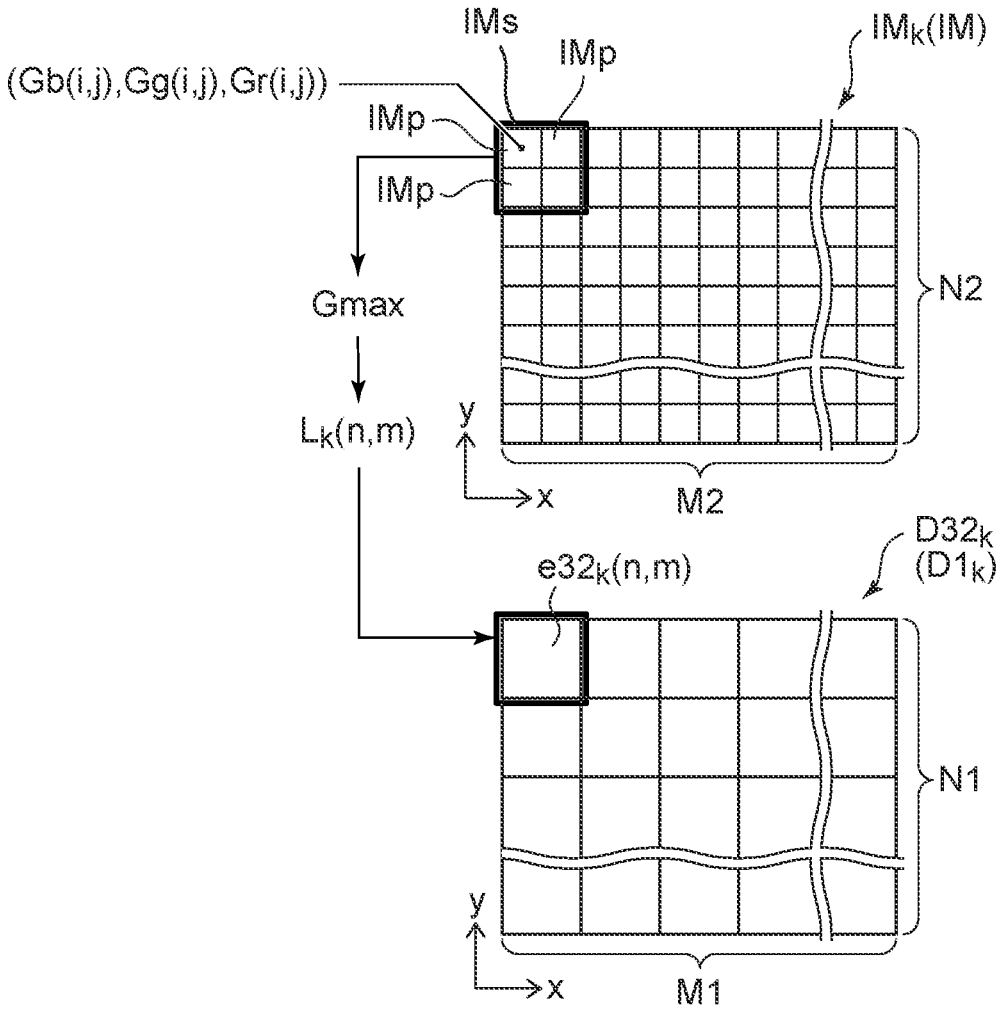
FIG. 13 is a schematic diagram showing a process of generating luminance setting data in an image display method according to a third embodiment.

FIG. 13 is a schematic diagram showing a process of generating luminance setting data in an image display method according to the third embodiment.

Figure 14:
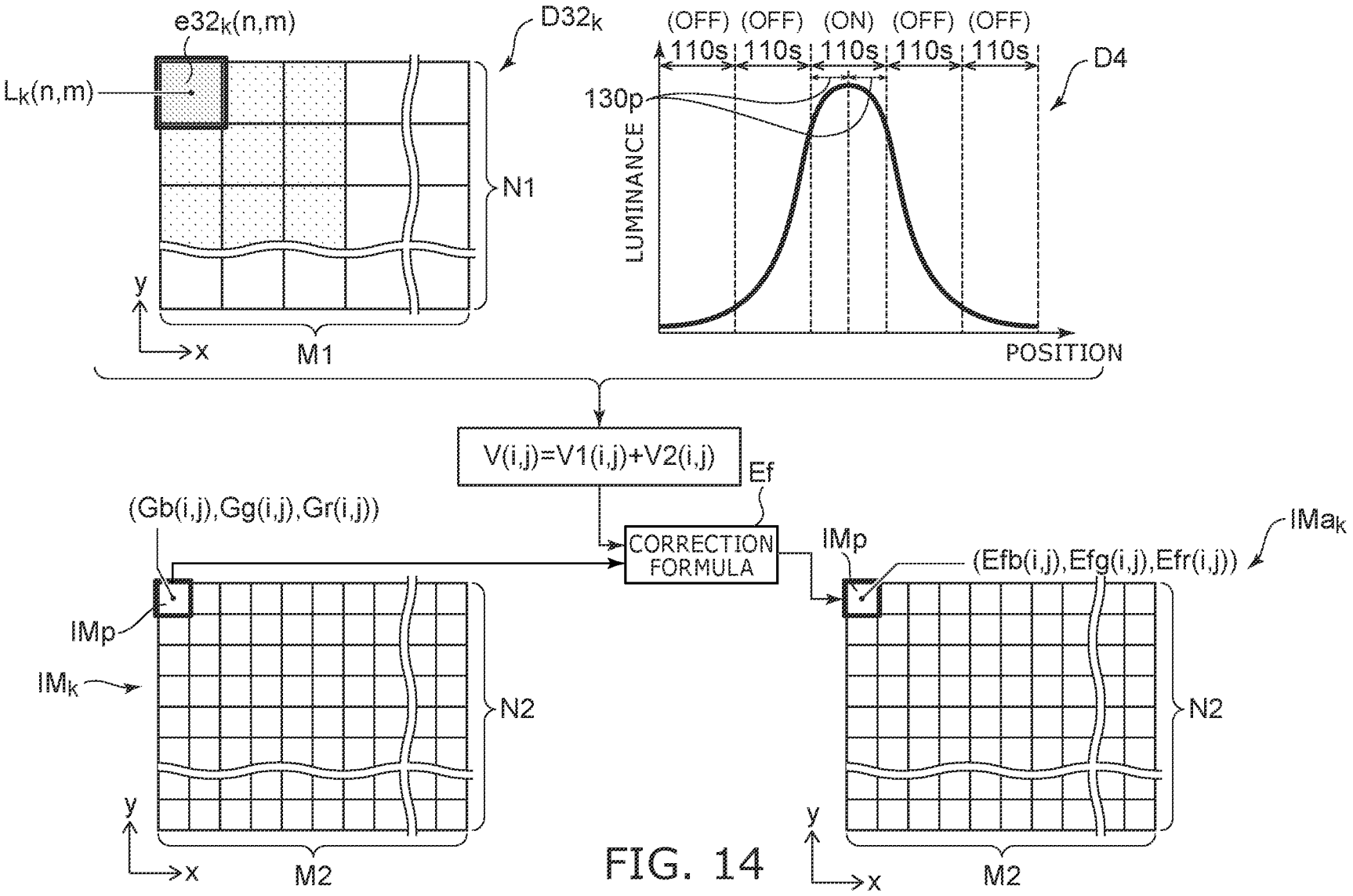
FIG. 14 is a schematic diagram showing a process of generating gradation setting data in the image display method according to the third embodiment.
Figure 15:
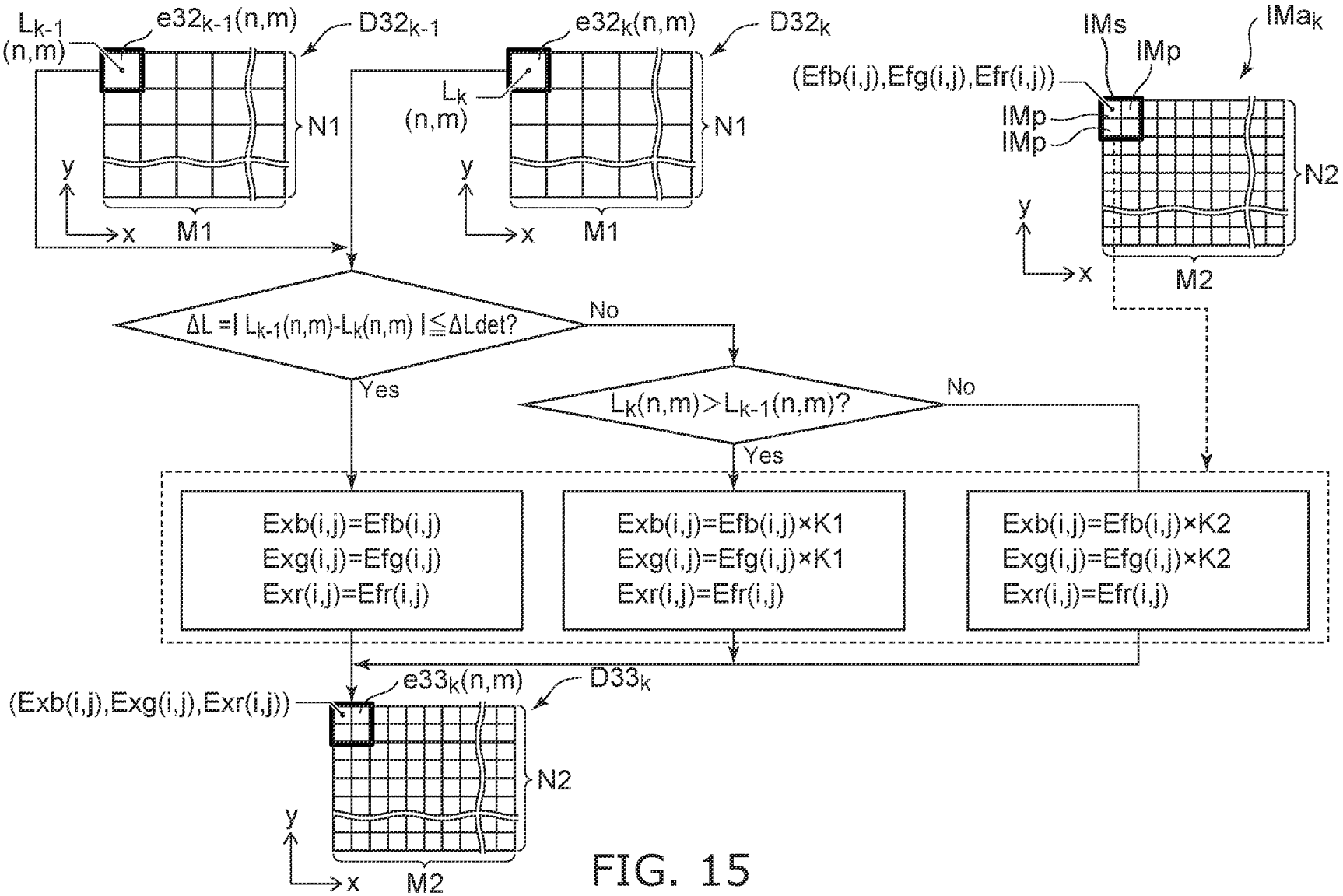
FIG. 15 is a schematic diagram showing a process of generating the gradation setting data in the image display method according to the third embodiment.

FIGS. 14 and 15 are schematic diagrams showing a process of generating gradation setting data in the image display method according to the third embodiment.

The generation process S2 of luminance setting data $D32_k$ and the generation process S3 of gradation setting data $D33_k$ in the image display method according to the third embodiment are different from those in the image display method according to the first embodiment.

An example will now be described in which the difference of the response speeds between the light-emitting element 114*a* and the green phosphor 114*g* is sufficiently small, and the difference of the response speeds the light-emitting element 114*a* and the red phosphor 114*r* is large. In the following example, the blue light Lb corresponds to the first light, and the red light Lr corresponds to the second light. The red phosphor 114*r* corresponds to the first phosphor. The blue subpixel 130*sb* corresponds to the first subpixel, and the red subpixel 130*sr* corresponds to the second subpixel.

First, the generation process S2 of the luminance setting data $D32_k$ for the kth input image $IM_k$ will be described.

As shown in FIG. 13, the luminance setting data generator 153*a* generates the luminance data $D1_k$ in a manner similar to that in the first embodiment, and uses the luminance data $D1_k$ as the luminance setting data $D32_k$. Accordingly, according to the third embodiment, the value of an element $e32k(n, m)$ at the nth row and the mth column of the luminance setting data $D32_k$ is a luminance $L_k(n, m)$ converted from the maximum gradation Gmax. Hereinbelow, the luminance $L_k(n, m)$ is called "the setting value $L_k(n, m)$ of the luminance".

The generation process S3 of the gradation setting data $D33_k$ for the kth input image $IM_k$ will now be described. The gradation setting data generator 153*b* generates the gradation setting data $D33_k$ including a setting value Exb(i, j) of the gradation of the blue subpixel 130*sb*, a setting value Exg(i, j) of the gradation of the green subpixel 130*sg*, and a setting value Exr(i, j) of the gradation of the red subpixel 130*sr* for each pixel 130*p* of the liquid crystal panel 130, based on a modified image $IMa_k$ of the input image $IM_k$ that is modified using the luminance setting data $D32_k$.

First, as shown in FIG. 14, the gradation setting data generator 153*b* generates the modified image $IMa_k$. Specifically, the luminance value V(i, j) directly under the pixel at the ith row and the jth column is estimated using the luminance setting data $D32_k$ and the luminance distribution data D4. Then, the gradation setting data generator 153*b* uses the estimated luminance value V(i, j) and the correction formula Ef to correct gradations Gfb(i, j), Gfg(i, j), and Gfr(i, j) of the pixel IMp at the ith row and the jth column of the input image $IM_k$. The gradation setting data generator 153*b* uses the output value Efb(i, j) of the correction formula Ef as the blue gradation value of the pixel IMp at the ith row and the jth column of the modified image $IMa_k$, uses the output value Efg(i, j) as the green gradation value of the pixel IMp at the ith row and the jth column of the modified image $IMa_k$, and uses the output value Efr(i, j) as the red gradation value of the pixel IMp at the ith row and the jth column of the modified image $IMa_k$. Thus, in the modified image $IMa_k$, the blue gradation value Efb(i, j), the green gradation value Efg(i, j), and the red gradation value Efr(i, j) are associated in the pixel IMp at the ith row and the jth column.

Then, as shown in FIG. 15, the gradation setting data generator 153*b* calculates the luminance difference ΔL between the setting value $L_k(n, m)$ of the luminance of the element $e32_k(n, m)$ at the nth row and the mth column of the luminance setting data $D32_k$ of the input image $IM_k$ and a setting value $L_{k-1}(n, m)$ of the luminance of an element $e32_{k-1}(n, m)$ at the nth row and the mth column of luminance setting data $D32_{k-1}$ of the input image $IM_{k-1}$.

Next, the gradation setting data generator 153*b* determines whether or not the luminance difference ΔL is not more than the threshold ΔLdet. Also, the gradation setting data generator 153*b* determines the area IMs that corresponds to the light-emitting region 110*s* positioned at the nth row and the mth column of the modified image $IMa_k$.

When the luminance difference ΔL is determined to be not more than the threshold ΔLdet, the gradation setting data generator 153*b* uses the blue gradation value Efb(i, j) of pixels IMp included in the extracted area IMs of the modified image $IMa_k$ as the setting value Exb(i, j) of the blue gradation of an element $e33_k(i, j)$ corresponding to the gradation setting data $D33_k$ without correcting. Similarly, the gradation setting data generator 153*b* uses the green gradation value Efg(i, j) of pixels IMp included in the extracted area IMs as the setting value Exg(i, j) of the green gradation of the element $e33_k(i, j)$ corresponding to the gradation setting data $D33_k$ without correcting. Similarly, the gradation setting data generator 153*b* uses the red gradation value Efr(i, j) of pixels IMp included in the extracted area IMs as the setting value Exr(i, j) of the red gradation of the element $e33_k$(i, j) corresponding to the gradation setting data $D33_k$ without correcting.

When the difference ΔLa is determined to be more than the threshold ΔLdet, the luminance setting data generator 153*a* determines whether or not the setting value $L_k$(n, m) of the luminance is greater than the setting value $L_{k-1}$(n, m) of the luminance.

When the setting value $L_k$(n, m) of the luminance is determined to be greater than the setting value $L_{k-1}$(n, m) of the luminance, the gradation setting data generator 153*b* multiplies the blue gradation value Efb(i, j) of each pixel IMp included in the extracted area IMs by a correction coefficient K1. Then, the multiplied value is used as the setting value Exb(i, j) of the blue gradation of the element $e33_k$(i, j) corresponding to the gradation setting data $D33_k$. Similarly, the gradation setting data generator 153*b* multiplies the green gradation value Efg(i, j) of each pixel IMp included in the extracted area IMs by the correction coefficient K1. Then, the multiplied value is used as the setting value Exg(i, j) of the green gradation of the element $e33_k$(i, j) corresponding to the gradation setting data $D33_k$. The gradation setting data generator 153*b* uses the red gradation value Efr(i, j) of each pixel IMp included in the extracted area IMs as the setting value Exr(i, j) of the red gradation of the element $e33_k$(i, j) corresponding to the gradation setting data $D33_k$ without correcting.

When the setting value $L_k$(n, m) of the luminance is determined not to be greater than the setting value $L_{k-1}$(n, m) of the luminance, the gradation setting data generator 153*b* multiplies the blue gradation value Efb(i, j) of each pixel IMp included in the extracted area IMs by a correction coefficient K2. Then, the multiplied value is used as the setting value Exb(i, j) of the blue gradation of the element $e33_k$(i, j) corresponding to the gradation setting data $D33_k$. Similarly, the gradation setting data generator 153*b* multiplies the green gradation value Efg(i, j) of pixels IMp included in the area IMs by the correction coefficient K2. Then, the multiplied value is used as the setting value Exg(i, j) of the green gradation of the element $e33_k$(i, j) corresponding to the gradation setting data $D33_k$. The gradation setting data generator 153*b* uses the red gradation value Efr(i, j) of each pixel IMp(i, j) included in the extracted area IMs as the setting value Exr(i, j) of the blue gradation of the element $e33_k$(i, j) corresponding to the gradation setting data $D33_k$ without correcting.

The gradation setting data generator 153*b* performs the aforementioned processing for all of the pixels IMp of the modified image $IMa_k$. The gradation setting data $D33_k$ including the setting values Exb(i, j), Exg(i, j), and Exr(i, j) of the gradations of the subpixels 130*sb*, 130*sg*, and 130*sr* is generated thereby.

According to the third embodiment, in the light-emitting region 110*s* in which the luminance increases more than the threshold ΔLdet, the amount of the light from the light-emitting element 114*a* and the green phosphor 114*g* increases more quickly than the amount of the light from the red phosphor 114*r*; therefore, the color of the light Lw becomes a greenish-blue (cyan)-ish color. To address such an issue, according to the third embodiment, the correction coefficient K1 is set to a value less than 1 and multiplied by the blue gradation value Efb(i, j) and the green gradation value Efg(i, j). Thereby, for the pixels 130*p* positioned directly above the light-emitting regions 110*s* for which the luminance increases more than the threshold ΔLdet, the setting values Exb(i, j) and Exg(i, j) of the gradations of the subpixels 130*sb* and 130*sg* are determined to reduce the transmitted amounts of the blue light Lb and the green light Lg.

According to the third embodiment, in the light-emitting regions 110*s* for which the luminance reduces more than the threshold ΔLdet, the amount of the light from the red phosphor 114*r* when reducing decreases slower than the light amount the light from the light-emitting element 114*a* and the green phosphor 114*g*; therefore, the color of the light Lw becomes a reddish color. To address such an issue, according to the third embodiment, the correction coefficient K2 is set to a value greater than 1 and multiplied by the blue gradation value Efb(i, j) and the green gradation value Efg(i, j). Thereby, for the pixels 130*p* positioned directly above the light-emitting regions 110*s* for which the luminance reduces more than the threshold ΔLdet, the setting values Exb(i, j) and Exg(i, j) of the gradations of the subpixels 130*sb* and 130*sg* are determined to increase the transmitted amounts of the blue light Lb and the green light Lg.

In such a manner, the degradation of the color balance of the light Lw emitted from the light-emitting regions 110*s* can be reduced by adjusting the transmitted amounts of the lights Lb and Lg of the subpixels 130*sb* and 130*sg* of the liquid crystal panel 130.

Effects of the third embodiment will now be described.

In the image display method according to the third embodiment, the process S3 of generating the gradation setting data $D33_k$ for the input image $IM_k$ among the multiple input images IM includes calculating, for each light-emitting region 110*s*, the luminance difference ΔL between the setting value $L_k$(n, m) of the luminance of the luminance setting data $D32_k$ of the input image $IM_k$ and the setting value $L_{k-1}$(n, m) of the luminance of the luminance setting data $D32_{k-1}$(n, m) of the input image $IM_{k-1}$ that is immediately before the input image $IM_k$. Then, for the pixels 130*p* of the liquid crystal panel 130 positioned directly above the light-emitting regions 110*s* for which the luminance difference ΔL is greater than the threshold ΔLdet, the setting value Exb(i, j) of the blue gradation, the setting value Exg(i, j) of the green gradation, and the setting value Exr(i, j) of the red gradation are determined by correcting the modified image $IMa_k$ according to the change of the proportion of the light amount of the blue light Lb, the light amount of the green light Lg, and the light amount of the red light Lr included in the light Lw emitted from the light-emitting region 110*s* when the setting value of the luminance changes.

In such a manner, the degradation of the color balance of the light Lw emitted from the light-emitting regions 110*s* can be reduced by adjusting the balance of the transmitted amounts of the lights Lb, Lg, and Lr of the subpixels 130*sb* and 130*sr* of the liquid crystal panel 130.

According to the third embodiment, the blue gradation value Efb(i, j) that corresponds to the blue light Lb, the green gradation value Efg(i, j) that corresponds to the green light Lg, and the red gradation value Efr(i, j) that corresponds to the red light Lr are associated in pixels IMp of the modified image $IMa_k$. Then, the process of generating the gradation setting data $D33_k$ for the input image $IM_k$ includes determining, for the light-emitting regions 110*s* for which the luminance difference ΔL is greater than the threshold ΔLdet, the correction coefficients K1 and K2 according to the change of the proportion of the amount of the blue light Lb, the amount of the green light Lg, and the amount of the red light Lr included in the light Lw emitted from the light-emitting region 110*s* when the setting value of the luminance changes. For the pixels 130*p* that are positioned directly above the light-emitting regions 110*s* for which the luminance difference ΔL is greater than the threshold ΔLdet, the setting value Exb(i, j) of the blue gradation and the setting value Exg(i, j) of the green gradation are determined by multiplying the correction coefficients K1 and K2 by the blue gradation value Efb(i, j) and the green gradation value Efg(i, j) of the modified image $IMa_k$, respectively. As a result, the balance of the transmitted amounts of the lights Lb, Lg, and Lr of the subpixels 130*sb*, 130*sg*, and 130*sr* of the liquid crystal panel 130 can be adjusted by a simple method of multiplying by the correction coefficients K1 and K2.

For the light-emitting regions 110*s* for which the setting value $L_k$(n, m) of the luminance of the luminance setting data $D32_k$ of the input image $IM_k$ is greater than the setting value $L_{k-1}$(n, m) of the luminance of the luminance setting data $D32_{k-1}$ of the input image $IM_{k-1}$, the correction coefficient K1 is set to a value that is less than 1. For the light-emitting regions 110*s* for which the setting value $L_k$(n, m) of the luminance of the luminance setting data $D32_k$ of the input image $IM_k$ is less than the setting value $L_{k-1}$(n, m) of the luminance of the luminance setting data $D32_{k-1}$ of the input image $IM_{k-1}$, the correction coefficient K2 is set to a value that is greater than 1. Then, for the pixels 130*p* that are positioned directly above the light-emitting regions 110*s* for which the luminance difference ΔL is greater than the threshold ΔLdet, the correction coefficients K1 and K2 are multiplied by the blue gradation value Efb(i, j) and the green gradation value Efg(i, j) of the modified image $IMa_k$, respectively. As a result, the balance of the transmitted amounts of the lights Lb, Lg, and Lr of the subpixels 130*sb*, 130*sg*, and 130*sr* of the liquid crystal panel 130 can be adjusted by the simple method of multiplying by the correction coefficients K1 and K2.

Figure 16:
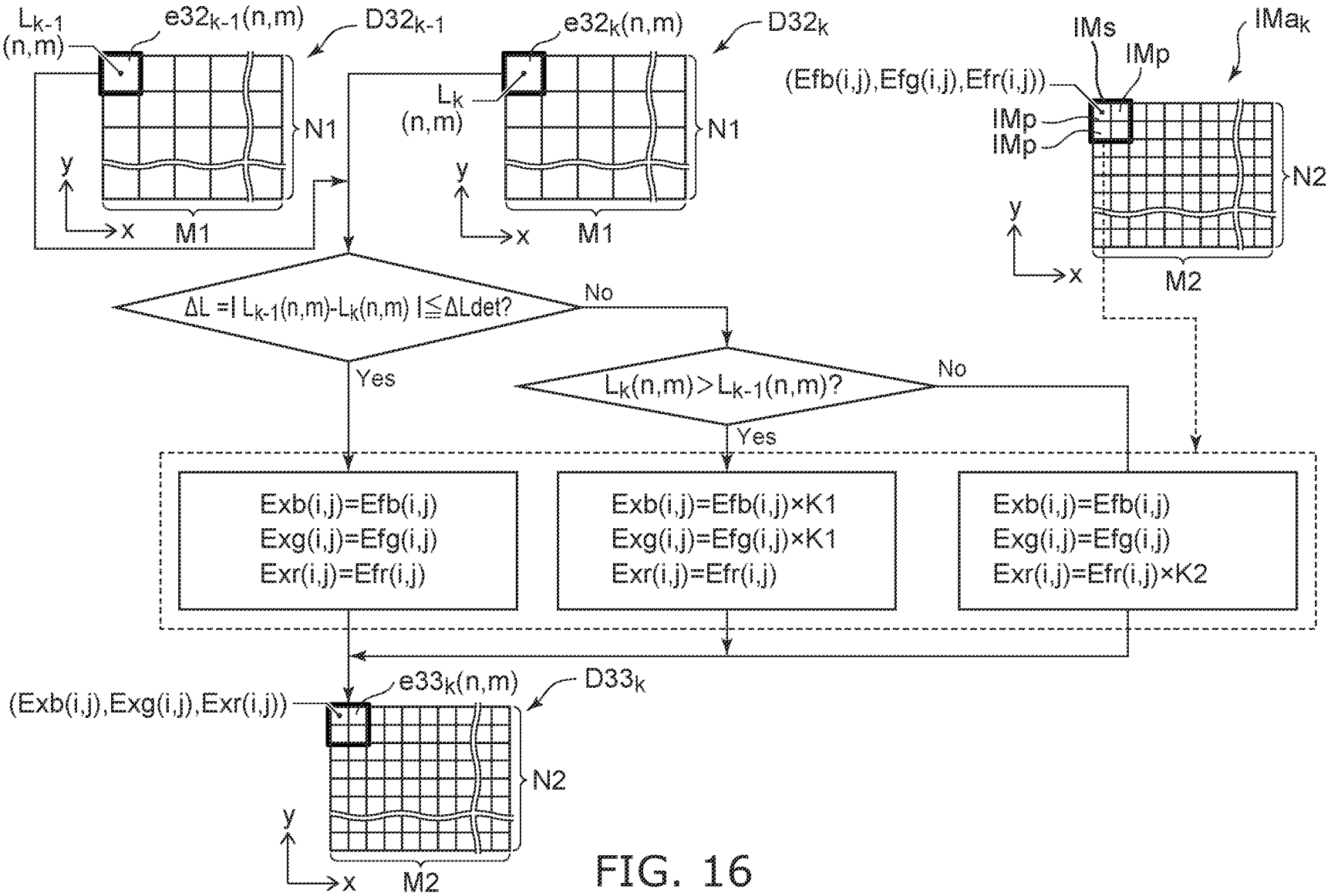
FIG. 16 is a schematic diagram showing a modification of the process of generating the gradation setting data.
Figure 17:
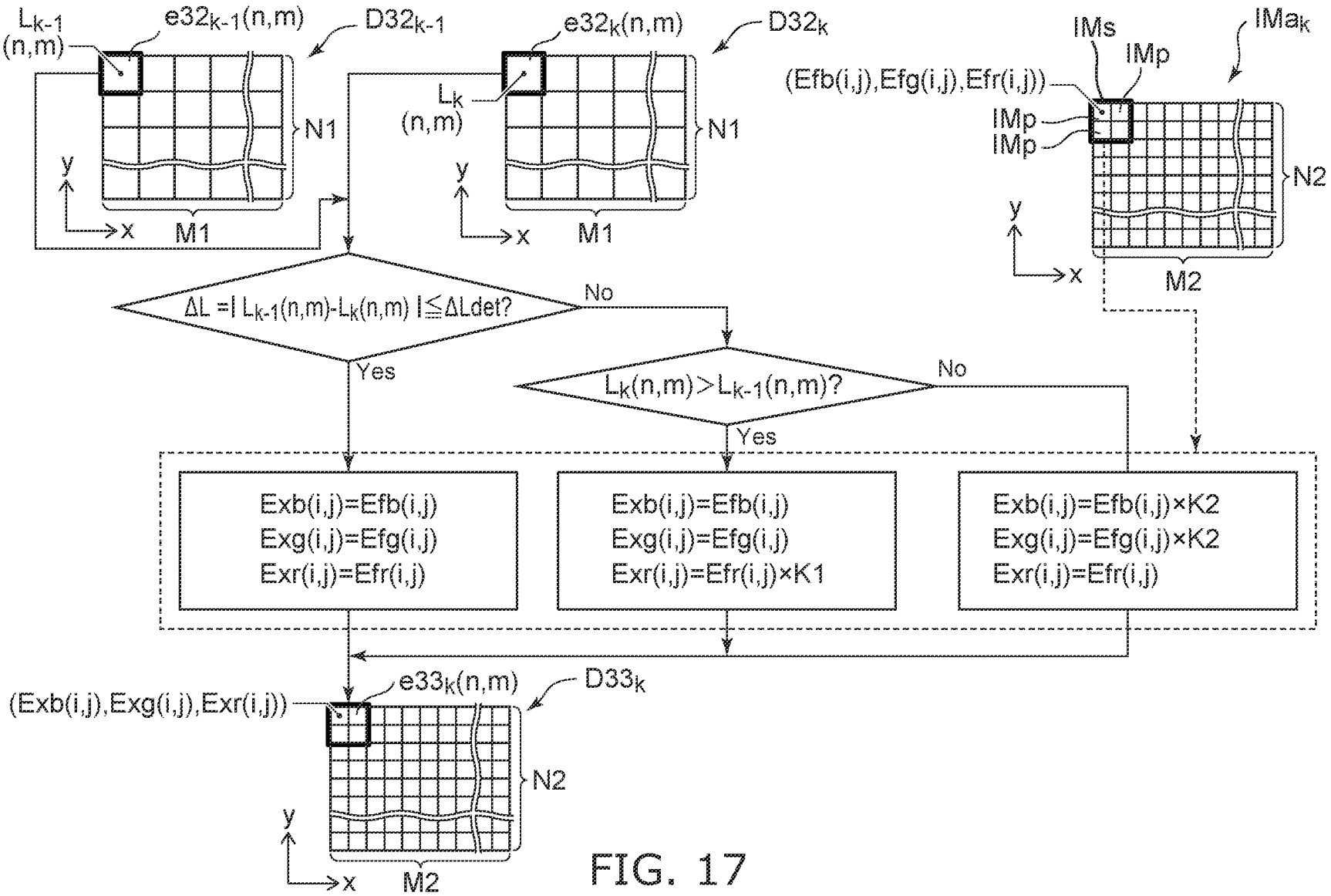
FIG. 17 is a schematic diagram showing another modification of the process of generating the gradation setting data.
Figure 18:
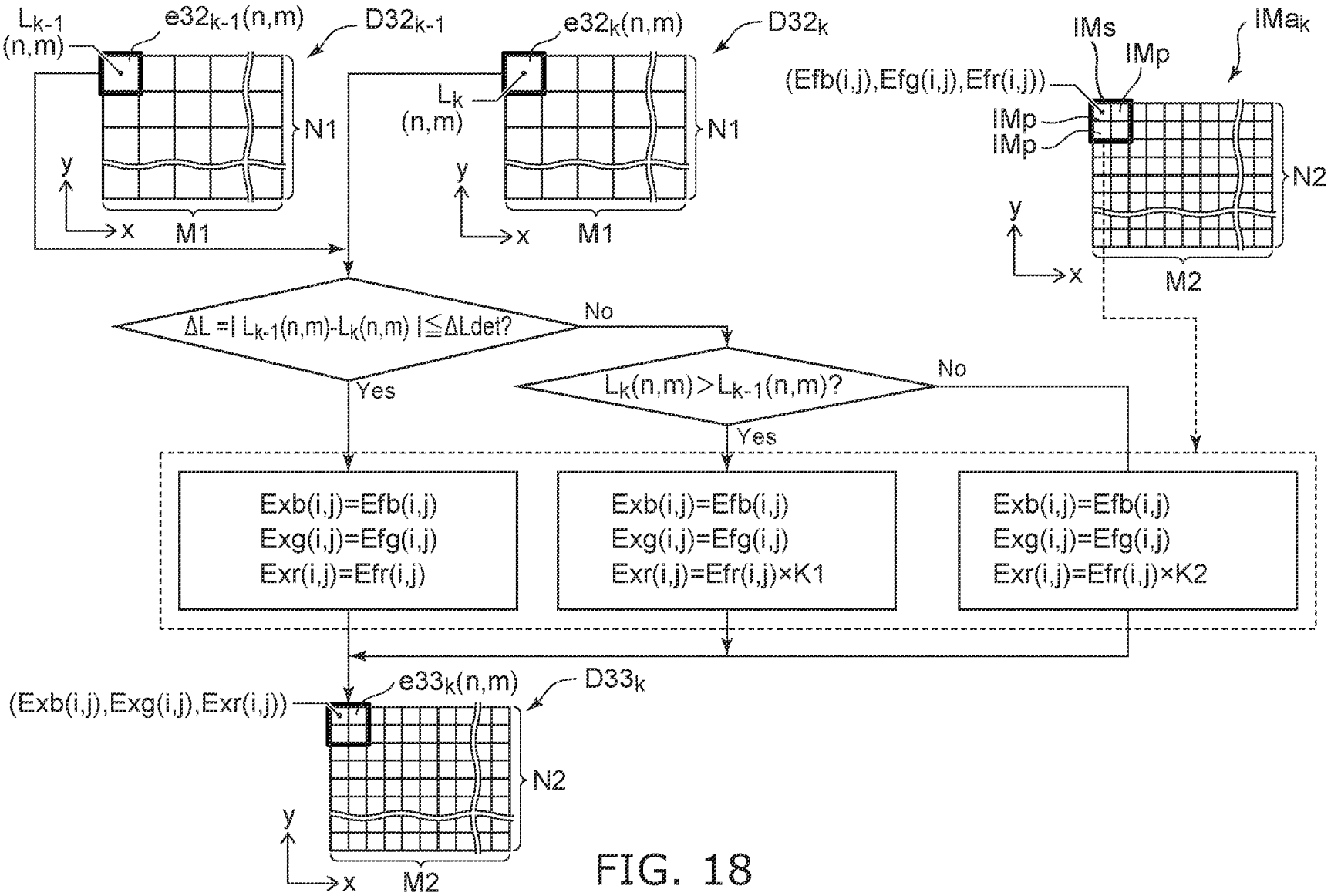
FIG. 18 is a schematic diagram showing still another modification of the process of generating the gradation setting data.

FIGS. 16 to 18 are schematic diagrams showing modifications of the process of generating the gradation setting data in the image display method according to the third embodiment.

As shown in FIG. 16, the correction coefficient K1 may be set to a value less than 1 and multiplied by the blue gradation value Efb(i, j) and the green gradation value Efg(i, j); and the correction coefficient K2 may be set to a value that is less than 1 and multiplied by the red gradation value Efr(i, j). In the liquid crystal panel 130, the color of the light Lw becomes reddish in the light-emitting regions 110*s* for which the luminance reduces more than the threshold ΔLdet. To address such an issue, for the pixels 130*p* that are positioned directly above the light-emitting regions 110*s* for which the luminance reduces more than the threshold ΔLdet, the setting value Exr(i, j) of the gradation of the red subpixel 130*sr* may be determined to reduce the transmitted amount of the red light Lr as in FIG. 16.

As shown in FIG. 17, the correction coefficient K1 may be set to a value is greater than 1 and multiplied by the red gradation value Efr(i, j); and the correction coefficient K2 may be set to a value greater than 1 and multiplied by the blue gradation value Efb(i, j) and the green gradation value Efg(i, j). The color of the light Lw becomes a greenish-blue (cyan)-ish color in the light-emitting regions 110*s* for which the luminance increases more than the threshold ΔLdet. To address such an issue, for the pixels 130*p* that are positioned directly above the light-emitting regions 110*s* for which the luminance increases more than the threshold ΔLdet, the setting value Exr(i, j) of the gradation of the red subpixel 130*sr* may be determined to increase the transmitted amount of the red light Lr as in FIG. 17.

As shown in FIG. 18, the correction coefficient K1 may be set to a value greater than 1 and multiplied by the red gradation value Efr(i, j); and the correction coefficient K2 may be set to a value less than 1 and multiplied by the red gradation value Efr(i, j).

The specific values of the correction coefficients K1 and K2 can be set as appropriate according to the type of the light-emitting element 114*a* and the types of the phosphors 114*g* and 114*r*. When the difference in the response speeds between the light-emitting element 114*a* and the green phosphor 114*g* is large enough to affect the degradation of the color balance the light Lw, the setting value Exb(i, j) of the blue gradation and the setting value Exg(i, j) of the green gradation may be determined by correcting the modified image $IMa_k$ according to the change of the proportion of the light amount of the blue light Lb and the light amount of the green light Lg.

The methods of the multiple embodiments described above can be combined as appropriate within the range of technical feasibility. For example, the method of the first embodiment and the method of the third embodiment can be combined. Specific methods will now be elaborated.

Similarly to the first embodiment, the setting value $L2_k$(n, m) of the luminance of each light-emitting region 110*s* of the luminance setting data $D2_k$ is determined based on the average value of the luminance $L_k$(n, m) of each area IMs of the luminance data $D1_k$ and the setting value $L2_{k-1}$ (n, m) of the luminance of each light-emitting region 110*s* of the luminance setting data $D2_{k-1}$.

Then, similarly to the third embodiment, the modified image $IMa_k$ is generated by correcting the input image $IM_k$ by using the luminance setting data $D2_k$.

Then, the luminance difference ΔL between the setting value $L_k$(n, m) of the luminance of the luminance setting data $D2_k$ and the setting value $L_{k-1}$(n, m) of the luminance of the luminance setting data $D2_{k-1}$ (n, m) is calculated for each light-emitting region 110*s*.

Then, for the pixels 130*p* that are positioned directly above the light-emitting regions 110*s* for which the luminance difference ΔL is greater than the threshold ΔLdet, the setting value Exb(i, j) of the blue gradation, the setting value Exg(i, j) of the green gradation, and the setting value Exr(i, j) of the red gradation are determined by correcting the modified image $IMa_k$ according to the change of the proportion of the light amount of the blue light Lb, the light amount of the green light Lg, and the light amount of the red light Lr included in the light Lw emitted from the light-emitting region 110*s* when the setting value $L_{k-1}$(n, m) of the luminance changes to the setting value $L_k$(n, m) of the luminance.

For example, the invention can be utilized in the display of a device such as a television, a personal computer, a game machine, etc.

What is claimed is:

1. An image display method comprising:

with respect to each of a plurality of input images, generating luminance setting data that sets a luminance value for each of a plurality of light-emitting regions of a backlight configured in a matrix form based on the input image;

generating gradation setting data that sets a gradation value for each of a plurality of pixels of a liquid crystal panel coupled to the backlight, based on the generated luminance setting data and the input image; and controlling the backlight to operate based on the luminance setting data and the liquid crystal panel to operate based on the gradation setting data to display an image corresponding to the input image, wherein the luminance setting data for a first input image among the plurality of input images is generated based on the first input image and the luminance setting data for a second input image immediately preceding the first input image, said generating luminance setting data comprises, with respect to the first input image:

generating luminance data for the first input image that indicates a tentative luminance setting value for each of the plurality of light-emitting regions of the backlight based on the first input image, the tentative luminance setting value being a luminance value converted from a maximum gradation value among gradation values of pixels of the first input image that corresponds to the light-emitting region; and generating the luminance setting data for the first input image based on an average of the luminance data for the first input image and the luminance setting data for the second input image, with respect to each of the plurality of light-emitting regions, and said generating gradation setting data comprises, with respect to the first input image:

with respect to each of the pixels of the liquid crystal panel, determining an estimated luminance value of the backlight based on a luminance value of a corresponding light-emitting region of the backlight set in the luminance setting data for the first input image and luminance distribution data indicating distribution of luminance in the corresponding light-emitting region; and modifying a gradation value of the pixel indicated by the first input image using the estimated luminance value.

2. The image display method according to claim 1, wherein each of the light-emitting regions of the backlight corresponds to a plurality of pixels of the liquid crystal panel.

3. The image display method according to claim 1, wherein each of the light-emitting regions of the backlight corresponds to a single light-emitting element.

4. An image display method comprising:

with respect to each of a plurality of input images, generating luminance setting data that sets a luminance value for each of a plurality of light-emitting regions of a backlight configured in a matrix form based on the input image;

generating gradation setting data that sets a gradation value for each of a plurality of pixels of a liquid crystal panel coupled to the backlight, based on the generated luminance setting data and the input image; and controlling the backlight to operate based on the luminance setting data and the liquid crystal panel to operate based on the gradation setting data to display an image corresponding to the input image, wherein the gradation setting data for a first input image among the plurality of input images is generated based on the luminance setting data for the first input image and the luminance setting data for a second input image immediately preceding the first input image, wherein said generating gradation setting data comprises, with respect to the first input image:

with respect to each of the pixels of the liquid crystal panel, determining an estimated luminance value of the backlight based on a luminance value of a corresponding light-emitting region of the backlight set in the luminance setting data for the first input image and luminance distribution data indicating distribution of luminance in the corresponding light-emitting region;

generating a first modified image, by modifying a gradation value of each of the pixels indicated by the first input image using the estimated luminance value of the pixel;

calculating a difference between the luminance setting data for the first input image and the luminance setting data for the second input image with respect to each of the plurality of light-emitting regions; and modifying the gradation value of each of the pixels indicated by the first modified image based on the calculated difference.

5. The image display method according to claim 4, wherein the gradation value of one of the pixels indicated by the first modified image is modified only when the calculated difference of the corresponding light-emitting region is greater than a predetermined threshold value.

6. The image display method according to claim 4, wherein when the calculated difference of the corresponding light-emitting region is greater than the predetermined threshold value and a luminance value of the corresponding light-emitting region set in the luminance setting data for the first input image is greater than a luminance value of the corresponding light-emitting region set in the luminance setting data for the second input image, the gradation value of the one of the pixels indicated by the first modified image is modified to be a smaller value for blue and green and the gradation value of the one of the pixels indicated by the first modified image is maintained for red.

7. The image display method according to claim 6, wherein the gradation value of the one of the pixels indicated by the first modified image is modified to be a greater value for blue and green and the gradation value of the one of the pixels indicated by the first modified image is maintained for red, when the calculated difference of the corresponding light-emitting region is greater than the predetermined threshold value and the luminance value of the corresponding light-emitting region set in the luminance setting data for the first input image is less than the luminance value of the corresponding light-emitting region set in the luminance setting data for the second input image.

8. The image display method according to claim 4, wherein said generating the luminance setting data comprises, with respect to the first input image:

with respect to each of the plurality of light-emitting regions of the backlight, determining a luminance value based on a maximum gradation value among gradation values of image pixels of the first input image that correspond to the light-emitting region.

9. The image display method according to claim 4, wherein each of the light-emitting regions of the backlight corresponds to a plurality of pixels of the liquid crystal panel.

10. The image display method according to claim 4, wherein each of the light-emitting regions of the backlight corresponds to a single light-emitting element.

11. An image display method comprising:

with respect to each of a plurality of input images, generating luminance setting data that sets a luminance value for each of a plurality of light-emitting regions of a backlight configured in a matrix form based on the input image;

generating gradation setting data that sets a gradation value for each of a plurality of pixels of a liquid crystal panel coupled to the backlight, based on the generated luminance setting data and the input image; and controlling the backlight to operate based on the luminance setting data and the liquid crystal panel to operate based on the gradation setting data to display an image corresponding to the input image, wherein the luminance setting data for a first input image among the plurality of input images is generated based on the first input image and the luminance setting data for a second input image immediately preceding the first input image, the luminance setting data for the first input image is generated such that a difference between the luminance value for the first input image and the luminance value for the second input image is within a predetermined threshold value, with respect to each of the plurality of light emitting regions, and said generating luminance setting data comprises, with respect to the first input image:

generating luminance data for the first input image that indicates a tentative luminance setting value for each of the plurality of light-emitting regions of the backlight based on the first input image, the tentative luminance setting value for each light-emitting region being based on a maximum gradation value among gradation values of image pixels of the first input image that correspond to the light-emitting region;

calculating a difference between the luminance data for the first input image and the luminance setting data for the second input image with respect to each of the plurality of light-emitting regions;

when a difference between a tentative luminance setting value of a light-emitting region for the first input image and a luminance value of the light-emitting region for the second input image is less than the predetermined threshold value, setting the tentative luminance setting value as a luminance value of the light-emitting region in the luminance setting data for the first input image; and when the difference between the tentative luminance setting value of the light-emitting region for the first input image and the luminance value of the light-emitting region for the second input image is greater than the predetermined threshold value, setting the luminance value of the light-emitting region for the second input image plus or minus the predetermined threshold value as a luminance value of the light-emitting region in the luminance setting data for the first input image.

12. The image display method according to claim 11, wherein said generating gradation setting data comprises, with respect to the first input image:

with respect to each of the pixels of the liquid crystal panel, determining an estimated luminance value of the backlight based on a luminance value of a corresponding light-emitting region of the backlight set in the luminance setting data for the first input image and luminance distribution data indicating distribution of luminance in the corresponding light-emitting region; and modifying a gradation value of the pixel indicated by the first input image using the estimated luminance value.

13. The image display method according to claim 11, wherein each of the light-emitting regions of the backlight corresponds to a plurality of pixels of the liquid crystal panel.

14. The image display method according to claim 11, wherein each of the light-emitting regions of the backlight corresponds to a single light-emitting element.

* * * * *